US007473511B2

(12) United States Patent
Matsumura et al.

(10) Patent No.: US 7,473,511 B2
(45) **Date of Patent: *Jan. 6, 2009**

(54) PARTICLE DISPERSION FOR ELECTROSTATIC IMAGE-DEVELOPING TONERS, ELECTROSTATIC IMAGE-DEVELOPING TONER, AND METHOD FOR PRODUCING THE SAME

(75) Inventors: Yasuo Matsumura, Minamiashigara (JP); Hirotaka Matsuoka, Minamiashigara (JP); Hideo Maehata, Minamiashigara (JP); Satoshi Hiraoka, Minamiashigara (JP); Yuki Sasaki, Minamiashigara (JP); Fumiaki Mera, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 343 days.

This patent is subject to a terminal disclaimer.

(21) Appl. No.: 11/119,834

(22) Filed: May 3, 2005

(65) Prior Publication Data

US 2006/0127790 A1 Jun. 15, 2006

(30) Foreign Application Priority Data

Dec. 15, 2004 (JP) ..... 2004-363264
Dec. 15, 2004 (JP) ..... 2004-363265

(51) Int. Cl.
*G03G 9/087* (2006.01)

(52) U.S. Cl. ..... 430/137.14; 528/274

(58) Field of Classification Search ..... 528/272, 528/274; 428/327; 430/137.14, 137.15
See application file for complete search history.

(56) References Cited

U.S. PATENT DOCUMENTS 4,355,154 A 10/1982 Saam et al.
5,346,797 A 9/1994 Kmiecik-Lawrynowicz et al.
2004/0019178 A1* 1/2004 Gross et al. ..... 528/274
2006/0165989 A1* 7/2006 Takikawa et al. ..... 428/402.2

FOREIGN PATENT DOCUMENTS

EP 0 626 406 A2 11/1994
JP A 63-282752 11/1988
JP A 06-250439 9/1994
JP A-2001-265058 9/2001

OTHER PUBLICATIONS

M. Barrere et al "Polyester synthesis in aqueous miniemulsion" Polymer 44(May 2003) pp. 2833-2841.*
Takasu et al; "Synthesis of Aliphatic Polyesters by Direct Polyesterification of Dicarboxylic Acids with Diols under Mild Conditions Catalyzed by Reusable Rare-Earth Triflate"; Macromolecules 2003; vol. 36; pp. 1772-1774.
Takasu et al., "Synthesis of Aliphatic Polyesters by Direct Polyesterification of Dicarboxylic Acids with Diols under Mild Conditions Catalyzed by Reusable Rare-Earth Triflate," *Macromolecules*, vol. 36, pp. 1772-1774 (2003).
Copending U.S. Appl. No. 11/115,206, filed Apr. 27, 2005 to Maehata et al.

* cited by examiner

*Primary Examiner*—John L Goodrow
(74) *Attorney, Agent, or Firm*—Oliff & Berridge, PLC

(57) ABSTRACT

The invention provides a particle dispersion for an electrostatic image-developing toner containing either polycondensation resin particles, which are prepared by polycondensation of polycondensable monomers in an aqueous medium, or condensation compound particles, which are prepared by dehydration condensation of a condensable compound in an aqueous medium. The particles have a median diameter of approximately 0.05 to 2.0 μm. A dispersion containing the polycondensation resin particles is produced by dispersing resin particles, aggregating the resin particles, and coalescing the aggregated particles by heating. A dispersion containing the condensation compound particles is produced by dispersing resin particles, dispersing condensation compound particles, aggregating the resin particles and the condensation compound particles in a mixture dispersion, obtained by mixing the dispersion of the resin particles and the dispersion of the condensation compound particles, and coalescing the aggregated particles by heating.

18 Claims, No Drawings

PARTICLE DISPERSION FOR ELECTROSTATIC IMAGE-DEVELOPING TONERS, ELECTROSTATIC IMAGE-DEVELOPING TONER, AND METHOD FOR PRODUCING THE SAME

CROSS-REFFRENCE TO RELATED APPLICATION

This application claims priority under 35 USC 119 from Japanese Patent Application Nos. 2004-363264 and 2004-363265, the disclosures of which are incorporated by reference herein.

BACKGROUND OF THE INVENTION

1. Field of Invention

The present invention relates to an electrostatic image-developing toner for use in developing with a developer electrostatic latent images formed by electrophotographic, electrostatic, or other recording method, a method for producing the same, and a dispersion of resin particles or condensation compound particles used as the raw material.

2. Description of the Related Art

Methods such as electrophotographic processes that visualize image information via electrostatic images are currently being used in a variety of fields. In such an electrophotographic process, image information is visualized by the steps of forming an electrostatic image on a photosensitive body by electrostatic charging or light exposure, developing the electrostatic latent image formed thereon with a developer containing a toner, and transferring and fixing the developed image. Both two-component developers, consisting of a toner and a carrier, and one-component developers, that employ only one magnetic or nonmagnetic toner are known as developers for use in such systems. Such toners are usually produced in a kneading-pulverizing process, comprising melt-blending a thermoplastic resin with a pigment, a charge-controlling agent, and a releasing agent such as a wax or the like, cooling the blend and pulverizing and classifying the cooled resin. Inorganic or organic microparticles are occasionally added to the toner if needed as an additive to the toner particle surface for improvement in fluidity and cleanability.

Recently, copying machines and printers using the color electrophotographic method, and multifunctional processing machines containing such devices as well as facsimile are becoming more and more popular. For obtaining a favorable glossiness of the images during reproduction of color images and a favorable transparency of OHP images, a great amount of oil is applied onto the fixing roll for facilitating release, because it is generally difficult to use a releasing agent such as wax. As a result, it becomes difficult to prevent a greasy feeling of the reproduced images, including those on OHP sheets, and to append additional characters or images on the image reproduced, for example, with a pen. In addition, the use of oil often results in uneven glossiness of images. It is difficult to use a wax such as polyethylene, polypropylene, or paraffin, which are commonly used for normal black-and-white copying, because they impair the transparency of the resulting OHP images.

When the conventional kneading pulverization process is used for producing a toner, not only does it result in problems such as deterioration in transparency but also a drastic deterioration in flowability and occurrence of filming on the developing machine, photosensitive body, and the like result when the toner is used as a developer, because of difficulty in controlling the amount of surface exposure of the releasing agent on the toner particle surface.

To overcome these problems thoroughly, proposed were processes for producing toners by polymerization, specifically, processes of forming a toner containing a wax capsulated inside and thereby controlling the exposure thereof on the surface, comprising dispersing an oil phase, containing a monomer of the base material for the resin and a colorant, in an aqueous phase and polymerizing the monomer directly into toner.

Further, methods of producing toners by an emulsion polymerization aggregation process were proposed in JP-A Nos. 63-282752 and 6-250439 as another means for systematically controlling of the shape and the surface structure of the toners. These documents teach general processes for producing toners, comprising producing a resin particle dispersion by emulsion polymerization or the like, producing a colorant dispersion containing a colorant dispersed in a solvent, mixing the resin particle dispersion and the colorant dispersion, forming aggregates corresponding to toner particles, and melt-coalescing the aggregates by heating.

These manufacturing processes not only allow capsulation of the wax in the toner particles, but also make easy a reduction of the toner particle diameter, and enable reproduction of sharper images higher in resolution.

As described above, for providing high-quality images in the electrophotography process and stabilized performance of the toner under various mechanical stresses, it is extremely important to optimize the kind and amount of the pigment and the releasing agent used, prevent exposure of the releasing agent on the particle surface, improve the glossiness of printed images by optimization of the resin properties and the releasing property without using a fixing oil, and control hot offsetting.

On the other hand, low-temperature image-fixing processes are desirable in view of minimizing energy consumption. Especially, in recent years, there exists the need for thorough energy-saving means, for example, by the terminating of electric supply except during use. As a result, such a fixing device should have a function to raise its temperature to an operating temperature in an instant. For that purpose, the heat capacity of the fixing device is desirably as small as possible. However in such a case, fluctuation in temperature of the fixing device often becomes greater than conventionally. For example, the overshoot temperature after starting electric supply becomes larger, and the decrease in temperature by the conveying of paper also becomes greater. Also if paper smaller in width than that of the fixing device is fed continuously, the difference between the temperatures of the paper-traveling area and the non-traveling area becomes enlarged. In particular, high-speed copying machines and printers when using the above function, often do not have a sufficiently large electric capacity, often resulting in the phenomena described above. Accordingly, there exists a strong need for a so-called wider-fixing-latitude electrophotographic toner that can be fixed at low temperature and does not cause offsetting until a higher temperature range is reached.

Use of a crystalline polycondensation resin or a crystalline condensation compound that exhibits a sharper melting behavior with respect to temperature as the binder resin for toner is known to be effective for lowering the fixing temperature of toner. However, because crystalline resins are more difficult to pulverize by the melt-kneading pulverization process they thus often cannot be used.

Polymerization of a polycondensation resin or production of a crystalline condensation compound normally also demands reaction conditions such as a high temperature of over 200° C., agitation under greater power, a highly reduced pressure, and a period of 10 hours or more, and therefore consumes a great amount of energy. Further, it often demands a large facility investment to ensure the durability of the reaction facilities.

When a toner is produce by the emulsion polymerization aggregation method as described above, after a crystalline polycondensation resin or crystalline condensation compound is produced by polymerization, it can be converted into a latex condition by emulsifying the resin or compound above in an aqueous medium, and coagulating it with a pigment, a wax, and the like, and melt-coalescing the resulting aggregate.

However, emulsification of a polycondensation resin or a crystalline condensation compound requires extremely inefficient and high-energy consumption processes to be used, for example, an emulsification process at a temperature of more than 100° C. to 150° C. under high-shear, or a process of dispersing in an aqueous medium a low-viscosity solution of the resin or compound which has been dissolved in a solvent, and then removing the solvent.

Because of the difficulty of avoiding the problem of hydrolysis during the emulsification in an aqueous medium, the generation of uncertainty factors in material design was also unavoidable.

Although these problems are significant when using crystalline resins, the same problems do not only occur when using crystalline resins but also when using noncrystalline resins.

There is a report that it is possible to perform polycondensation of polyester in an aqueous medium, which has been regarded as difficult (U.S. Pat. No. 4,355,154). There is also a report of polycondensation of polyester performed in an aqueous medium in the presence of a catalyst having a sulfonic acid group (U.S. Pat. No. 4,355,154).

SUMMARY OF THE INVENTION

As described above, in the conventional preparative methods for toner, a crystalline polycondensation resin obtained by polymerization or a crystalline condensation compound obtained by synthesis is emulsified in an aqueous medium. However, it would be more advantageous if it is possible to produce a resin particle or a condensation compound in an aqueous medium as in the reports above, because the process of emulsifying the particles of the resin or condensation compound in the aqueous medium becomes unnecessary.

However, in the reports exemplified above, the resin particles are emulsified and dispersed in an aqueous medium in a rather unstable state. Thus, production of toner from such a dispersion causes problems, for example, worsening of the toner particle diameter and the distribution thereof, and consequently leads to a deterioration in image quality. Thus, it is not possible currently to produce toners having desirable characteristics by such methods. In addition, even when a crystalline polycondensation resin obtained by polymerization or a crystalline condensation compound obtained by synthesis is emulsified in an aqueous medium, the resin particles are emulsified and dispersed in an unstable state in the aqueous medium. It is desirable to improve the situation above, from the viewpoint of recent technical requirements.

In consideration of the situation above, the present invention aims to solve the problems above in the past and achieve the following objects. Namely, the invention provides a resin particle dispersion for electrostatic image-developing toners containing resin particles stably emulsified and dispersed at low energy consumption in an aqueous medium, and a condensation compound particle dispersion for electrostatic image-developing toners containing resin particles stably emulsified and dispersed at low energy consumption in an aqueous medium. It also provides a method of producing an electrostatic image-developing toner that allows production of an electrostatic image-developing toner sufficiently satisfying desirable toner characteristics by using at least one of these dispersions, and an electrostatic image-developing toner obtained thereby.

The present invention has been made in view of the above circumstances. Namely, the invention provides a resin particle dispersion for an electrostatic image-developing toner comprising polycondensation resin particles, wherein the polycondensation resin particles are prepared by polycondensation of polycondensable monomers in an aqueous medium and have a median diameter of approximately 0.05 to 2.0 μm.

Further, the present invention provides a condensation compound particle dispersion for an electrostatic image-developing toner comprising condensation compound particles, wherein the condensation compound particles are prepared by dehydration condensation of a condensable compound in an aqueous medium and have a median diameter of approximately 0.05 to 2.0 μm.

In one embodiment, the polycondensation resin particles or the condensation compound particles are crystalline and have a crystal melting point of from approximately 50° C. to 120° C.

In another embodiment, the polycondensable monomer or the condensable compound contains at least a polyvalent carboxylic acid and a polyol.

In another embodiment, the polycondensable monomer is polycondensed or the condensable compound is dehydration-condensed in a presence of an acid having surfactant properties as a catalyst.

In another embodiment, polycondensable monomer is polycondensed or the condensable compound is dehydration-condensed in a presence of a rare-earth metal-containing catalyst or a hydrolytic enzyme as a catalyst.

Further, the invention provides a method of producing electrostatic image-developing toners, including: polycondensing the polycondensable monomers in an aqueous medium to obtain a polycondensation resin particle dispersion, dispersing a polycondensation resin in an aqueous medium to obtain the polycondensation resin particle dispersion; aggregating the resin particles in the resin particle dispersion so as to obtain aggregated particles; and coalescing the aggregated particles by heating.

Further, the invention provides a method of producing electrostatic image-developing toners, including: dispersing a resin in an aqueous medium to obtain a resin particle dispersion; dispersing a condensation compound in an aqueous medium to obtain a condensation compound particle dispersion; mixing the resin particle dispersion and the condensation compound particle dispersion to obtain a mixture dispersion, aggregating the resin particles and the condensation compound particles in the mixture dispersion to obtain aggregated particles; and coalescing the aggregated particles by heating, Furthermore, the invention provides an electrostatic image-developing toner obtained by any of the methods of producing electrostatic image-developing toners.

DETAILED DESCRIPTION OF THE INVENTION

Hereinafter, the present invention will be described in detail.

Dispersion for Electrostatic Image-developing Toners

The resin particle dispersion for the electrostatic image-developing toners according to the invention (hereinafter, simply referred to as a resin particle dispersion according to the invention) is obtained by preparing polycondensation resin particles by direct polycondensation of a polycondensable monomer in an aqueous medium. Further, the condensation compound particle dispersion for the electrostatic image-developing toners according to the invention (hereinafter, simply referred to as a condensation compound particle dispersion according to the invention) is obtained by preparing condensation compound particles by direct condensation of a condensable compound in an aqueous medium. In the dispersions, the polycondensation resin particles and the condensation compound particles each are emulsified and dispersed in an aqueous medium at a median diameter of approximately 0.05 μm or more and 2.0 μm or less.

The polycondensation resin/condensation compound particles in these dispersions according to the invention can be produced at low energy consumption, because the polycondensation resin/condensation compound particles are directly polycondensation in an aqueous medium in such a manner that the polycondensation resin/condensation compound particles have a median diameter of approximately 0.05 μm or more and 2.0 μm or less. In addition, these dispersions, in which each of the respective polycondensation resin/condensation compound particles is isolated from each other in the aqueous medium, are stable for an extended period of time until a coagulation operation by using a coagulant for production of toners is initiated. Aggregate particles are formed in a highly controlled manner only after the aggregation operation. Therefore, use of the dispersions according to the invention leads to more favorable control of the particle diameter distribution of toner particles and uniformization of the composition and structure of the toner particles, and consequently provides toners having satisfactory toner characteristics.

The median diameter (mean diameter) of the polycondensation resin/condensation compound particles is approximately 0.05 μm or more and 2.0 μm or less, preferably approximately 0.1 μm or more and 1.5 μm or less, and more preferably approximately 0.1 μm or more and 1.0 μm or less. The polycondensation resin/condensation compound particles having a median diameter in the above range become dispersed in the aqueous medium in a stable condition as described above. Dispersions containing particles having an excessively smaller median diameter causes problems during production of a toner such as deterioration in coagulation efficiency during particle production, increase in the frequency of generating free resin particles, and increase in the viscosity of the system, making it difficult to control the particle diameter of the toner. On the other hand, dispersions containing particles having an excessively large median diameter causes problems such as occurrence of peeling or lowering of a release offsetting temperature in the fixing step because of the expansion of the particle diameter distribution due to facile generation of coarse particles and increase in the frequency of generating free condensation compound particles and releasing agent particles such as wax.

The median diameter of the polycondensation resin/condensation compound particles can be determined, for example, by using a laser diffraction particle size analyzer (trade name: LA-920, manufactured by Horiba Ltd.).

In addition, in the dispersions according to the invention, ultra-fine and ultra-coarse particles of the polycondensation resin/condensation compound particles are preferably contained in a smaller amount. Namely, a weight ratio of the polycondensation resin/condensation compound particles that have a median diameter of approximately 0.03 μm or less or approximately 5.0 μm or more in the dispersion is preferably approximately 10% or less and more preferably approximately 5% or less relative to a total number of the polycondensation resin/condensation compound particles. The ratio can be calculated by plotting the integrated frequency against the particle diameter from the measurement results by the laser diffraction particle diameter distribution analyzer, and determining the integrated frequency of the particles of 0.03 μm or less, or 5.0 μm or more.

Hereinafter, method of producing the dispersions according to the invention will be described. For production of the dispersions according to the invention, first, a polycondensable monomer or a condensable compound, a raw material for desirable particles, is emulsified and dispersed in an aqueous medium, for example, by means of mechanical shear or supersonic wave. Additives such as catalyst (condensation catalyst/polycondensation catalyst) and surfactant may be added to the aqueous medium as needed at the same time. Polycondensation of the polycondensable monomer or the dehydration condensation of the condensable compound is then allowed to proceed, for example, by heating the solution thus obtained.

The polycondensation reaction of the polycondensable monomer and the dehydration condensation reaction of the condensable compound are reactions accompanied by dehydration and accordingly do not proceed in an aqueous medium in principle. However, for example, if the polycondensable monomer or condensable compound is emulsified in an aqueous medium together with a surfactant that forms micelles in an aqueous medium, the dehydration reaction occurs, as the monomer is incorporated in a microscopically hydrophobic environment of micelle. The polycondensation reaction or condensation reaction can be proceeded by expelling the generated water out of the micelle into the aqueous medium. In this manner, a dispersion of polycondensation resin or condensation compound particles emulsified and dispersed in an aqueous medium is obtained at low energy consumption.

Preferable examples of the methods for controlling the median diameter of the polycondensation resin/condensation compound particles thus obtained in the range above and reducing the ratio of polycondensation resin/condensation compound particles having a larger or smaller particle diameter include the following methods.

1) The polycondensable monomer/condensable compound is not directly added to an aqueous medium, but first blended and fused with other additive(s) (examples thereof include a catalyst and surfactant). The resulting oily solution is then added to an aqueous medium, and the mixture emulsified and dispersed by a first agitation (e.g., by homogenizer) and a second agitation (e.g., by supersonic wave).

2) The polymerizable monomer/condensable compound is mixed and fused with other additive(s) (examples thereof include a catalyst and surfactant); the thus obtained oily solution is stirred and roughly emulsified in an aqueous medium which is heated to, for example, approximately 100° C. (e.g., by homogenizer) and then the more finely emulsified (e.g., by nanomizer manufactured by Yoshida Kikai Co., Ltd.).

3) The polymerizable monomer/condensable compound is mixed and fused with other additive(s) (examples thereof include a catalyst and surfactant); after addition of a solvent (e.g., ethyl acetate or the like) in a small amount, the mixture is stirred and roughly emulsified in an aqueous medium (e.g., by homogenizer) and then the more finely emulsified (e.g., by nanomizer which is provided by such as Yoshida Kikai Co., Ltd.); and then, the solvent is removed while the mixture is stirred and heated to, for example, approximately 60° C.

4) The polymerizable monomer/condensable compound is mixed and fused with other additive(s) (examples thereof include a catalyst and surfactant); the thus obtained oily solution is stirred and emulsified with a gradual addition of an aqueous medium heated, for example, to approximately 100° C. (e.g., by homogenizer); and further, the mixture is subjected to phase inversion emulsification by addition of an aqueous medium, and optionally, a surfactant if it is needed.

In addition, a catalyst, which includes a polycondensation catalyst and a condensation catalyst in it scope, is commonly used for polycondensation/condensation of a polycondensable monomer/condensable compound at low temperature. Preferable examples of the catalysts that are active at low temperature include acids, rare-earth metal-containing catalysts, and hydrolytic enzymes having a surfactant activity. By using these catalysts, it becomes possible to make the polycondensation/condensation reaction proceed in an aqueous medium at a normal temperature of, for example, approximately 100° C. or less. For faster progress of the polycondensation/condensation or for use of a wider range of monomers, the polycondensation/condensation may be conducted in an aqueous medium heated to approximately 100° C. or more.

The acid having a surface-activating property, which has a chemical structure consisting of a hydrophobic group and a hydrophilic group, in which at least a part of the hydrophilic group has a structure of a protonic acid, is a catalyst which plays both an emulsification function and a catalytic function. Preferable examples of the acid having a surfactant property include alkylbenzenesulfonic acids such as dodecylbenzenesulfonic acid, isopropylbenzenesulfonic acid, keryl benzenesulfonic acid, or camphor sulfonic acid; alkylsulfuric acids; alkyldisulfonic acids; alkylphenolsulfonic acids; alkylnaphthalenesulfonic acids; alkyltetralinsulfonic acids; alkylallylsulfonic acids; petroleum sulfonic acid; alkylbenzimidazolesulfonic acids, higher alcoholether sulfonic acids; alkyldiphenylsulfonic acids; monobutylphenylphenolsulfuric acids; dibutylphenylphenolsulfuric acids; higher aliphatic acid sulfuric acid esters such as dodecyl sulfate; higher alcohol sulfuric acid esters; higher alcohol ether sulfuric acid esters; higher aliphatic acid amide alkylated sulfuric acid esters; higher aliphatic acid amide alkylated sulfuric acid esters; naphthenylalcohol sulfuric acid; sulfated aliphatic acids; sulfoscuccinic acid ester; various aliphatic acids; sulfonated higher aliphatic acids; higher alkylphosphoric acid esters; resin acids; resin acid alcohol sulfuric acids; naphthenic acids; salts thereof, and the like. These acids having a surfactant property may be used in combination in accordance with needs.

Examples of the elements contained in the rare-earth metal-containing catalysts include lanthanoid elements such as lanthanum (La), cerium (Ce), praseodymium (Pr), neodymium (Nd), promethium (Pm), samarium (Sm), europium (Eu), gadolinium (Gd), terbium (Th), dysprosium (Dy), holmium (Ho), erbium (Er), thulium (Tm), ytterbium (Yb), and lutetium (Lu). Particularly Preferable example of the rare-earth metal-containing catalysts include alkylbenzenesulfonic acid salts, alkylsulfuric ester salts, and compounds having a triflate structure. The metal triflate is preferably a compound represented by a structural formula of $X(OSO_2CF_3)_3$, wherein X is scandium (Sc), yttrium (Y), ytterbium (Yb), samarium (Sm), or the like.

Lanthanoid triflates are also favorable as the rare-earth metal-containing catalyst. Details of lanthanoid triflates are described in J. Soc. Syn. Org. Chem., Vol. 3(4), pp. 44-54.

The hydrolytic enzyme is not particularly limited provided that it catalyzes an ester synthesis reaction. Examples of the hydrolytic enzymes include esterases classified in EC (enzyme code) 3.1 group such as carboxyesterase, lipase, phospholipase, acetylesterase, pectin esterase, cholesterol esterase, tannase, monoacylglycerol lipase, lactonase, or lipoprotein lipase (see, "Enzyme Handbook" edited by Maruo and Tamiya, Asakura Publishing Company Ltd. (1982) or others); hydrolytic enzymes which react with glycosyl compounds classified in EC3.2 group such as glucosidase, galactosidase, glucuronidase, or xylosidase; hydrolytic enzymes classified in EC 3.3 group such as epoxide hydrase; hydrolytic enzymes which react with peptide bonds classified in EC 3.4 group such as amino peptidase, chymotrypsin, trypsin, plasmin, ord subtilisin; hydrolytic enzyme classified in EC 3.7 group such as phloretin hydrase; and the like.

Among these esterases, enzymes hydrolyzing a glycerol ester and liberating aliphatic acids are particularly called lipases. Lipases have many advantages including high stability in organic solvents, high activity of catalyzing ester synthesis reactions at high yield and lower cost in availability. Accordingly, from the viewpoints of yield and cost, lipases are preferably used in productions of the polyesters favorable as the material for the polycondensation resin/condensation compound particles according to the invention described below.

Lipases obtained of various sources can be used. Preferable examples thereof include lipases obtained from microbes such as *Pseudomonas, Alcaligenes, Achromobacter, Candida, Aspergillus, Rhizopus*, or *Mucor*; lipases obtained from vegetable seeds; lipases obtained from animal tissues; pancreatin, steapsin, and the like. Among them, lipases obtained from microbes of *Pseudomonas, Candida*, or *Aspergillus* species are preferably used.

These catalysts may be used alone or in combination of two or more.

Preferable examples of the condensable compounds used in the dehydration condensation include carboxylic acids and alcohols. A typical example of the condensable compound obtained by dehydration condensation between a carboxylic acid and an alcohol is an ester wax (ester compound).

The Preferable examples of the carboxylic acids include monocarboxylic acids and polyvalent carboxylic acids. Examples of the monocarboxylic acids include a myristic acid, palmitic acid, stearic acid, arachic acid, behenic acid, rignoceric acid, cerotic acid, montanic acid, melissic acid, and the like.

The polyvalent carboxylic acids are compounds having two or more carboxyl groups in a molecule thereof. Among them, bivalent carboxylic acids are compounds having two carboxyl groups in a molecule thereof, and example thereof include an oxalic acid, succinic acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, maleic acid, citric acid, hexahydroterephthalic acid, malonic acid, pimelic acid, tartaric acid, mucic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediglycolic acid, p-phenylenediglycolic acid, o-phenylenediglycolic acid, diphenylacetic acid, diphenyl-p,p-dicarboxylic acid, naphthalene-1,4-dicarboxylic acid, naphthalene-1,5-dicarboxylic acid, naphthalene-2,6-dicarboxylic acid, anthracenedicarboxylic acid, and the like. In addition, examples of polyvalent carboxylic acids other than the bivalent carboxylic acids include a trimellitic acid, pyromellitic acid, naphthalenetricarboxylic acid, naphthalenetetracarboxylic acid, pyrenetricarboxylic acid, pyrenetetracarboxylic acid, and the like.

On the other hand, the alcohols include monovalent alcohols and bivalent or higher-valent alcohols. Examples of the monovalent alcohols include a myristyl alcohol, cetyl alcohol, stearyl alcohol, alalkyl alcohol, behenyl alcohol, tetracosanol, hexacosanol, octacosanol, triacontanol, and the like.

In addition, examples of the bivalent alcohols include an ethylene glycol, propylene glycol, 1,3-propanediol, 1,4-butanediol, 1,5-pentanediol, 1,6-hexanediol, cyclohexanediol, 1,10-decanediol, 1,12-dodecanediol, 1,14-tetradecanediol, 1,16-hexadecanediol, 1,18-octadecanediol, 1,20-eicosanediol, 1,30-triacontanediol, diethylene glycol, dipropylene glycol, 2,2,4-trimethyl-1,3-pentanediol, neopentylglycol, 1,4-cyclohexanedimethanol, spiroglycol, 1,4-phenyleneglycol, bisphenol A, hydrogenated bisphenol A, and the like. Examples of the trivalent alcohols include a 1,2,4-butanetriol, 1,2,5-pentanetriol, 2-methyl-1,2,4-butanetriol, glycerol, 2-methylpropanetriol, trimethylolethane, triethylolethane, trimethylolpropane, 1,3,5-trihydroxymethylbenzene, and the like. Examples of the quadrivalent alcohols include 1,2,3,6-hexanetetrol, pentaerythritol, and the like. Examples of the pentavalent alcohols include glucose and the like, and examples of hexavalent alcohols include dipentaerythritol and the like.

Further, examples of polyols other than the other bivalent alcohols (polyol) above include hexamethylol melamine, hexaethylol melamine, tetramethylol benzoguanamine, tetraethylol benzoguanamine, and the like.

Preferable examples of the condensable compounds for use in the dehydration condensation include amines. Dehydration condensation of an amine with one of the monocarboxylic acids described above gives a crystalline amide as the condensation compound.

Examples of the amines include various monoamines and diamines described below. Examples of the diamines include an ethylenediamine, diethylenediamine, triethylenediamine, 1,2-propylenediamine, 1,3-propylenediamine, 1,4-butanediamine, 1,4-butenediamine, 2,2-dimethyl-1,3-butanediamine, 1,5-pentanediamine, 1,6-hexanediamine, 1,4-cyclohexanediamine, 1,4-cyclohexanedimethylamine, and the like.

The condensation compound obtained is preferably crystalline; and the melting point thereof is preferably in a range of approximately 50° C. to 120° C., more preferably of approximately 50° C. to 100° C., and still more preferably of approximately 60° C. to 90° C. If the condensation compound has an excessively higher melting point, deterioration in a low-temperature fixing property, a separation efficiency from fixing roll, and a hot-offset resistance occur for the toner. Further, if the compound has an excessively lower melting point, plasticization of the binder resin which deteriorates blocking efficiency occurs, and separation efficiency from fixing roll as well as hot-offset resistance of the toner may further deteriorate.

Examples of the polycondensable monomers for use in polycondensation include polyvalent carboxylic acids, polyols, and polyamines. Particularly preferable examples of the polycondensable monomers include those containing a polyvalent carboxylic acid and a polyol to provide a polyester.

Examples of the polyvalent carboxylic acids for use as the polycondensable monomer include those exemplified as the polyvalent carboxylic acids for use in the dehydration condensation.

Particularly Preferable examples of the polyvalent carboxylic acids for use as the polycondensable monomer include an azelaic acid, sebacic acid, 1,9-nonanedicarboxylic acid, 1,10-decamethylenedicarboxylic acid, 1,11-undecanedicarboxylic acid, 1,12-dodecanedicarboxylic acid, terephthalic acid, trimellitic acid, pyromellitic acid, and the like. These polyvalent carboxylic acids are hardly soluble or insoluble in water, and thus the ester synthesis reaction proceeds in a suspension in which the polyvalent carboxylic acid is dispersed in water.

Among the polyols for use as the polycondensable monomer, preferred examples of bivalent polyols include an ethylene glycol, propylene glycol, butanediol, diethylene glycol, hexanediol, cyclohexanediol, octanediol, decanediol, dodecanediol, and the like. Preferable examples of the polyols for use as the polycondensable monomer other than the bivalent polyols include glycerol, pentaerythritol, hexamethylol melamine, hexaethylol melamine, tetramethylol benzoguanamine, tetraethylol benzoguanamine, and the like.

Particularly Preferable examples of the polyols for use as the polycondensable monomer include bivalent polyols such as 1,8-octanediol, 1,10-decanediol, and 1,12-dodecanediol, and the like. These polyols are hardly soluble or insoluble in water, and thus the ester synthesis reaction proceeds in a suspension wherein the polyol is dispersed in water.

It is also possible to easily produce amorphous resins and crystalline resins by combining these polycondensable monomers.

Examples of the polyvalent carboxylic acids for use in producing crystalline polyesters or polyamides include an oxalic acid, malonic acid, succinic acid, glutalic acid, adipic acid, pimelic acid, suberic acid, azelaic acid, sebacic acid, maleic acid, fumaric acid, citraconic acid, itaconic acid, glutaconic acid, n-dodecylsuccinic acid, n-dodecenylsuccinic acid, isododecylsuccinic acid, isododecenylsuccinic acid, n-octylsuccinic acid, n-octenylsuccinic acid, and acid anhydrides or acid chlorides thereof.

Examples of the polyols for use in producing the crystalline polyester include an ethylene glycol, diethylene glycol, triethylene glycol, 1,2-propylene glycol, 1,3-propylene glycol, 1,4-butanediol, 1,4-butenediol, neopentyl glycol, 1,5-pentane glycol, 1,6-hexane glycol, 1,4-cyclohexanediol, 1,4-cyclohexane dimethanol, dipropylene glycol, polyethylene glycol, polypropylene glycol, polytetramethylene glycol, bisphenol A, bisphenol Z, hydrogenated bisphenol A, and the like.

Examples of the polyamines for use in producing the polyamide include an ethylenediamine, diethylenediamine, triethylenediamine, 1,2-propylenediamine, 1,3-propylenediamine, 1,4-butanediamine, 1,4-butenediamine, 2,2-dimethyl-1,3-butanediamine, 1,5-pentanediamine, 1,6-hexanediamine, 1,4-cyclohexanediamine, 1,4-cyclohexanedimethylamine, and the like.

The polycondensation resin obtained by polycondensation of the polycondensable monomers is preferably crystalline. Use of the crystalline polycondensation resin makes the low-temperature fixing of the toner much easier.

Examples of such crystalline polycondensation resins include polyesters obtained by a reaction of 1,9-nonanediol and 1,10-decamethylenecarboxylic acid or a reaction of cyclohexanediol and adipic acid; polyesters obtained by a reaction of 1,6-hexanediol and sebacic acid; polyesters obtained by a reaction of ethylene glycol and succinic acid;

polyesters obtained by a reaction of ethylene glycol and sebacic acid; and polyesters obtained by a reaction of 1,4-butanediol and succinate. Among them, polyesters obtained polyesters obtained by a reaction of 1,9-nonanediol and 1,10-decamethylenecarboxylic acid and polyesters obtained by a reaction of 1,6-hexanediol and sebacic acid are more preferable.

The melting point Tm of the crystalline polycondensation resins is in a range of approximately 50 to 120° C. and preferably of approximately 55 to 90° C. The resin having a Tm of lower than approximately 50° C. may cause deterioration in release efficiency during fixation and more frequent hot offsetting since a cohesive force of the binder resin itself in the high-temperature range is lowered. The resin having a Tm of higher than approximately 120° C. may cause insufficient melting which leads to raising of a lowest fixing temperature.

In the invention, the melting point of crystalline resin can be determined from the peak melting temperature as measured in an input-compensation differential scanning calorimeter (DSC) at a programmed rate of 10° C. per minute from room temperature to 150° C. according to a known method. Crystalline resins often have multiple melting peaks, however, in the invention, the maximum peak in DSC measurement is regarded as the melting point. Further, the glass transition point of the amorphous resin is a value determined by the differential scanning calorimetry (DSC) as specified in ASTM D3418-82.

On the other hand, the glass transition point Tg of amorphous polycondensation resin particles is preferably in a range of approximately 50 to 80° C. and more preferably of approximately 50 to 65° C. The resin having a Tg of lower than approximately 50° C. causes frequent hot offsetting during fixation. which is due to deterioration in a cohesive force of the binder resin per se in a high-temperature range. The resin having a Tg of higher than approximately 80° C. may cause raising a lowest fixing temperature due to insufficient melting.

A weight-average molecular weight of the polycondensation resin obtained by polycondensation of the polycondensable monomers is in a range of approximately 1,500 to 60,000 and preferably of approximately 3,000 to 40,000. The resin having a weight-average molecular weight of lower than approximately 1,500 may cause deterioration in hot-offsetting property due to decreasing in the cohesive force between binder and resin. The resin having a weight-average molecular weight of higher than approximately 60,000 may have a favorable hot-offsetting property but may cause increaing of a lowest fixing temperature. The polycondensation resin may include a partially branched structure, a cross-linked structure and the like, depending on the valencies of carboxylic acid or alcohol of the monomers used.

The median diameter of the polycondensation resin obtained by polycondensation of the polycondensable monomers is preferably approximately 10 μm or less, more preferably approximately 7 μm or less; and the most preferabley approximately 1 μm or less. The resins having a particle diameter of more than approximately 10 μm are not favorable because of deterioration in image quality properties including resolution when used as a toner. In addition, the resins having a particle diameter of more than approximately 10 μm are unfavorable, because of insufficiency in the increase of molecular weight and speed during polycondensation during production and from the viewpoint of the quality and intensity of images after fixation.

For production of polycondensation resin particles having a determined particle diameter in an aqueous medium, a common heterogeneous polymerization system in an aqueous medium such as suspension polymerization method, solubilization dispersion method, miniemulsion method, microemulsion method, macroemulsion method, multi-stage swelling method, or emulsion polymerization method including seeding polymerization may be used as the polymerization method. Further, in this case, polymerization methods which provide submicron-sized particles of approximately 1 μm or less in diameter such as the miniemulsion method or microemulsion method is more preferable since manufacturing styles thereof achieve producing particles having a diameter of approximately 1 μm or less, that is the most preferable particle diameter since the results of the polycondensation reaction, in particular the final molecular weight and the polymerization rate, depend on a final particle diameter of the particles as described above, as well as efficiency in the production.

When the polycondensation/dehydration condensation of the polycondensable monomers/condensable compound is conducted in an aqueous medium, the above-described respective materials are emulsified and dispersed in an aqueous medium by using, for example, a mechanical shearing or supersonic wave. A surfactant, a polymer dispersing agent, an inorganic dispersing agent, or the like may be added to the aqueous medium during the emulsification and dispersion in accordance with necessity.

Examples of the surfactants used in the invention include anionic surfactants such as sulfate ester salts, sulfonic acid salts, or phosphoric acid esters; cationic surfactants such as amine salts or quaternary ammonium salts; nonionic surfactants such as polyethylene glycols, alkylphenol ethylene oxide adducts, or polyvalent alcohols; and the like. Among them, anionic and cationic surfactants are preferable. The nonionic surfactants are preferably used in combination with anionic or cationic surfactants. The surfactants may be used alone or in combination of two or more. Examples of the anionic surfactants include sodium dodecylbenzenesulfonate, sodium alkylnaphthalenesulfonates, sodium arylalkylpolyethersufonates, sodium 3,3-disulfone-diphenylurea-4,4-diazobis-amino-8-naphthol-6-sufonate, ortho-carboxybenzene-azo-dimethylaniline, sodium 2,2,5,5-tetramethyl-triphenylmethane-4,4-diazo-bis-β-naphthol-6-sufonate, sodium dialkylsulfosuccinates, sodium dodecylsulfate, sodium tetradecylsulfate, sodium pentadecylsulfate, sodium octylsulfate, sodium oleate, sodium laurate, sodium caprate, sodium caprylate, sodium caproate, potassium stearate, calcium oleate, and the like. Examples of the cationic surfactants include alkylbenzenedimethylammonium chlorides, alkyltrimethylammonium chlorides, distearylammonium chloride, and the like. Examples of the nonionic surfactants include polyethylene oxide, polypropylene oxide, combinations of polypropylene and polyethylene oxides, esters from polyethylene glycol and a higher aliphatic acid, alkylphenol polyethylene oxide, esters from a higher aliphatic acid and polyethylene glycol, esters from a higher aliphatic acid and polypropylene oxide, sorbitan esters, and the like. In addition, examples of the polymer dispersing agents include sodium polycarboxylates, polyvinylalcohol, and the like; and examples of the inorganic dispersing agents include calcium carbonate and the like, but the invention is not limited thereto. For prevention of the Ostwald Ripning phenomenon of the monomer emulsion particles in an aqueous medium, a higher alcohol represented by heptanol and octanol, a higher aliphatic hydrocarbon represented by hexadecane, or the like may be added as a stabilization additive.

When the polycondensation of the polycondensable monomers is conducted in an aqueous medium, components commonly used in toners such as colorant, fixing aid such as wax, and electrification additive may be added in advance to the aqueous medium and incorporated into the polycondensation resin particles as the polycondensation progresses.

Method of Producing Electrostatic Image-developing Toners

The method of producing the electrostatic image-developing toners according to the invention includes: aggregating particles (aggregation process) by coagulation of particles in a dispersion of resin particles which at least contain the polycondensation resin particles according to the invention or a dispersion of the condensation compound particles and the resin particles according to the invention; and coalescing the aggregated particles (coalescence process) by heating. The method of production is grouped in the method generally called an emulsion polymerization aggregation.

In the aggregation process, the polycondensation resin particles according to the invention or the condensation compound particles according to the invention are produced in an aqueous medium, and thus, the resulting product can be directly used as a dispersion. Aggregate particles having a diameter suitable for toner can be produced by, in case of necessity, mixing the particle dispersion with a colorant particle dispersion or a releasing agent particle dispersion, and adding a coagulant thereto and making these particles heterocoagulate. In addition, it is also possible to coat the particles with a shell layer, by forming the first aggregate particles in the above-described manner and then adding the resin particle dispersion according to the invention or another resin particle dispersion thereto. Although the colorant dispersion is separately prepared in this example, the colorant dispersion is not needed if a colorant is added to the polycondensation resin particles in advance.

After finishing aggregating, the aggregate particles are coalesced as heated at a temperature higher than the glass transition point of the resin particles, washed as needed, and dried in the coalescing (fusing/coalescing process), to provide a toner.

After finishing coalescing, the desired toner particles are processed in an optional washing process, a solid-liquid separation process, and a drying process; and the particles are preferably thoroughly washed with ion-exchanged water, considering the electrification properties of the resulting toner. The solid-liquid separation process is not particularly limited, but is preferably filtration under reduced or applied pressure or the like, from the point of productivity. Further, the drying is also not particularly limited, but freeze drying, flash jet drying, fluidized bed drying, vibrationally fluidized bed drying, and the like are preferably used from the viewpoint of productivity.

Hereinafter, respective components for the toner (materials used for production) will be described.

In addition to a surfactant, an inorganic salt or a bivalent or higher metal salt can be preferably used as the coagulant. In particular, use of a metal salt is preferable from the viewpoints of an efficiency of aggregation control and toner electrification. In addition, a surfactant may be used, for example, for emulsion polymerization of resin, dispersion of pigment, dispersion of resin particles, dispersion of releasing agent, aggregation, stabilization of aggregated particles, and the like. Specifically, combined use of an anionic surfactant such as a sulfate ester salt, sulfonic acid salt, phosphoric acid ester or soap or a cationic surfactant such as an amine salt or quaternary ammonium salt and a nonionic surfactant such as polyethylene glycol, alkylphenol ethylene oxide adduct, or polyvalent alcohol is effective, and any one of common dispersion means such as a rotary shearing homogenizer, ball mill, sand mill, or Dynomill dynomill that employs a medium may be used as the dispersion means.

Specifically, when the polycondensation resin particle dispersion according to the invention is used, an addition polymerized resin particle dispersion prepared by, for example, a known emulsion polymerization method, may be used in combination with the polycondensation resin particle dispersion.

Examples of the addition polymerizable monomers for production of these resin particle dispersions include homopolymers and copolymers of a vinyl monomers, and example thereof include styrenes such as styrene or p-chlorostyrene; vinylesters such as vinylnaphthalene, vinyl chloride, vinyl bromide, vinyl fluoride, vinyl acetate, vinyl propionate, vinyl benzoate, or vinyl buryrate; methylene aliphatic carboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, α-chloromethyl acrylate, methyl methacrylate, ethyl methacrylate, or butyl methacrylate; acrylonitrile; methacrylonitrile; acryl amides; vinyl ethers such as vinylmethylether, vinylethylether, or vinyl isobutylether; monomers having an N-containing polar group such as N-vinyl compounds including N-vinylpyrrole, N-vinylcarbazole, N-vinylindolel, and N-vinylpyrrolidone; vinylcarboxylic acids such as methacrylic acid, acrylic acid, cinnamic acid, or carboxyethyl acrylate; and the like. In addition, various waxes may be used in combination therewith.

When an addition polymerization monomer is used, the resin particle dispersion may be produced by emulsion polymerization in a presence of an ionic surfactant; or alternatively, when an other resin is used, the resin particle dispersion may be produced by, dissolving the resin in an oily solvent in a case when the resin is relatively insoluble in water but soluble in the oily solvent, and dispersing the resin in an aqueous medium together with an ionic surfactant or a polymer electrolyte into a form of particles by using a dispersing machine such as a homogenizer, and then removing the solvent by heating or under reduced pressure.

Specifically, for the purpose of enabling low-temperature fixing, a crystalline resin is preferably used as the resin (binder resin) for the resin particles in the dispersion containing the condensation compound particles and resin particles according to the invention.

The crystalline resin is preferably a crystalline polyester resin, and is more preferably an aliphatic crystalline polyester resin having a suitable melting point. Hereinafter, the crystalline polyester resin will be described as an example.

The crystalline aliphatic polyesters include polyesters such as polycaprolactone that are produced by ring-opening polymerization; however, many of them are prepared from an acid (dicarboxylic acid) component and an alcohol (diol) component. In the invention, the term "acid-derived component" is a component that is an acid before preparation of polyester resin prepared therefrom, while the term "alcohol-derived component" a component that is an alcohol before preparation of polyester resin prepared therefrom.

If the polyester resin is not crystalline, i.e., amorphous, it is not possible to provide the toner with a favorable toner-blocking resistance and stability of stored images while retaining a favorable low-temperature fixing property. Accordingly, in the invention, the "crystalline polyester resin" is a resin that has a distinct endothermic peak instead of a stepwise change in heat absorption in differential scanning calorimetry (DSC). If an additional component is copolymerized into a main chain of the crystalline polyester, the copolymer containing the additional component in an amount of about 50 wt % or less is also called a crystalline polyester.

The acid-derived component is preferably a aliphatic dicarboxylic acid and particularly a straight-chain carboxylic acid. Preferable examples thereof include, but are not limited to, an oxalic acid, malonic acid, succinic acid, glutalic acid, adipic acid, pimelic acid, suberic acid, azelic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, lower alkyl esters or acid anhydrides thereof, and the like.

Preferable examples of the acid-derived components other than the aliphatic dicarboxylic acid-derived components include dicarboxylic acid-derived components having double bond(s), dicarboxylic acid-derived components having sulfonic acid group(s), and the like.

Examples of the dicarboxylic acid-derived components having a double bond include components derived from the dicarboxylic acids having a double bond, components derived from the lower alkyl esters or acid anhydrides of the dicarboxylic acids having a double bond, and the like. In addition, examples of the dicarboxylic acid-derived components having a sulfonic acid group include components derived from the dicarboxylic acids having a sulfonic acid group, components derived from the lower alkyl esters or acid anhydrides of the dicarboxylic acids having a sulfonic acid group, and the like.

The dicarboxylic acid having a double bond is preferably used for prevention of hot offsetting in fixing, as it enables cross inking of the entire resin by using its double bond. Examples of such dicarboxylic acids include, but are not limited to, fumaric acid, maleic acid, 3-hexenedioic acid, 3-octenedioic acid, lower alkyl esters thereof, acid anhydrides thereof, and the like. Among them, fumaric acid, maleic acid, and the like are preferable from the viewpoint of cost.

The dicarboxylic acid having a sulfonic acid group is effective in dispersing colorants such as pigments and the like. When toner particles are prepared from the emulsion or dispersion of the resin in water, presence of the sulfonic acid group enables emulsification or dispersion without use of the surfactant as described below. Examples of the dicarboxylic acids having a sulfonic acid group include, but are not limited to, sodium salt of 2-sulfoterephthalate, sodium salt of sodium 5-sulfoisophthalate, sodium salt of sulfosuccinate, lower alkyl esters thereof, acid anhydrides thereof, and the like. Among them, sodium salt of 5-sulfoisophthalate or the like are preferable from the viewpoint of cost.

The content ratio of acid-derived components other than the aliphatic dicarboxylic acid-derived components (namely, dicarboxylic acid-derived components having a double bond and/or dicarboxylic acid-derived components having a sulfonic acid group) relative to the acid-derived components is preferably approximately 1 to 20 constitutive mol % and more preferably approximately 2 to 10 mol %.

When the content is less than approximately 1 constitutive mol %, controlling the toner diameter by coagulation may be difficult because of problems such as an insufficient dispersing of pigments, increase in the diameter of emulsified particles, and the like. On the other hand, when the content exceeds approximately 20 constitutive mol %, deterioration in the fastness of images due to decrease in the crystallinity of the polyester resin, lowering of melting point, and the like may occur, as well as an inability of producing latexes due to solubilization of the emulsified particles in water caused by excessively smaller diameter thereof.

In the invention, the term "constitutive mol %" means a percentage of each component in the polyester resin when the content of each component (a acid-derived component or an alcohol-derived component) is expressed by units (moles).

The alcohol component is preferably a aliphatic dicarboxylic acid, and preferable examples thereof include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol, 1,20-eicosanediol, and the like.

When the alcohol-derived component is an aliphatic diol-derived component, the aliphatic diol-derived component has a content ratio of approximately 80 constitutive mol % or more with respect to the total alcohol-derived components and may contain additionally other components as needed. When the alcohol-derived component is an aliphatic diol-derived component, the content ratio of the aliphatic diol-derived component with respect to the total alcohol-derived components is preferably approximately 90 constitutive mol % or more.

In a case that the aliphatic diol-derived component content is less than approximately 80 constitutive mol %, deteriorations in a toner-blocking resistance, stability of stored images, and low-temperature fixing property may occur due to decrease in the crystallinity of polyester resin and lowering of a melting point.

Examples of other components which may be contained in accordance with necessity include diol-derived components having a double bond(s), diol-derived components having a sulfonic acid group(s), and the like.

Examples of the diols having a double bond(s) include 2-butene-1,4-diol, 3-butene-1,6-diol, 4-butene-1,8-diol, and the like. Examples of the diols having a sulfonic acid group(s) include sodium salt of 1,4-dihydroxy-2-benzenesufonate, sodium salt of 1,3-dihydroxymethyl-5-benzenesufonate, sodium salt of 2-sulfo-1,4-butanediol, and the like.

When an alcohol-derived component which are other than the straight-chain aliphatic diol-derived components are added, namely, when a diol-derived component having a double bond and/or a diol-derived component having a sulfonic acid group are added, the content ratio of the diol-derived component having a double bond and/or the diol-derived component having a sulfonic acid group relative to the total alcohol-derived components is preferably approximately 1 to 20 constitutive mol % and more preferably approximately 2 to 10 constitutive mol %.

When a content ratio of the alcohol-derived components other than the aliphatic diol-derived components relative to the total alcohol-derived components is less than 1 constitutive mol %, it may result in difficulty in controlling the toner diameter through aggregation due to problems such as insufficient dispersion of pigments, increase in the diameter of emulsified particles, or the like. On the other hand, when a content ratio is more than approximately 20 constitutive mol %, it may cause deterioration in a fastness of images due to problems such as decrease in a crystallinity of polyester resin, lowering of melting point, or the like and inability to produce latexes due to solubilization of emulsification particles in water due to excessively smaller diameter thereof.

The method of producing the polyester resin is not particularly limited, and a generally-known polyester polymerization method using reacting an acid component with an alcohol component can be used. Examples thereof include direct polycondensation, ester exchange, and the like, or the like can be selected according to kinds of monomers used. The molar ratio of the acid component relative to the alcohol component (acid component/alcohol component) cannot be generally defined since it vary according to reaction conditions and the like employed, however, the molar ratio is usually approximately 1/1.

The polyester resin can be produced at a polymerization temperature in a range of about 180 to 230° C. In the polyester resin production process, the condensation reaction is carried out while water and alcohol generated by condensation is removed under reduced pressure in accordance with necessity.

If the monomers are not soluble or compatible with each other at a reaction temperature, solubilization of the monomers may be intended by adding a high-boiling point solvent thereto as a solubilizing agent. The polycondensation reaction is carried out while the solubilizing agent is distilled off. If there is a monomer which is less compatible in a copolymerization reaction, the less-compatible monomer may be condensed in advance with an acid or alcohol to be polycondensed with the monomer before polycondensation with a main component.

Examples of the catalysts for use in production of the polyester resin include alkali metal compounds such as sodium compounds or lithium compounds; alkali earth metal compound such as magnesium compounds or calcium compounds; metal compounds such as compounds of zinc, manganese, antimony, titanium, tin, zirconium, or germanium; phosphorous acid compounds, phosphoric acid compounds, and amine compounds, and the like. Typical examples thereof include sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenylantimony, tributylantimony, tin formate, tin oxalate, tetraphenyltin, dibutyltin dichloride, dibutyltin oxide, diphenyltin oxide, zirconium tetrabutoxide, zirconium naphthenate, zirconyl carbonate, zirconyl acetate, zirconyl stearate, zirconyl octoate, germanium oxide, triphenyl phosphite, tris (2,4-di-t-butylphenyl)phosphite, ethyltriphenylphosphonium bromide, triethylamine, triphenylamine, and the like.

Other resins may be additionally used in combination with the above-described resin in order to further modifying them, and examples thereof as binder resins include homopolymers and copolymers of a vinyl monomer, and examples thereof include vinylesters such as vinylnaphthalene, vinyl chloride, vinyl bromide, vinyl fluoride, vinyl acetate, vinyl propionate, vinyl benzoate, or vinyl buryrate; methylene aliphatic carboxylic acid esters such as methyl acrylate, ethyl acrylate, n-butyl acrylate, isobutyl acrylate, dodecyl acrylate, n-octyl acrylate, 2-chloroethyl acrylate, phenyl acrylate, α-chloromethyl acrylate, methyl methacrylate, ethyl methacrylate, or butyl methacrylate; acrylonitrile; methacrylonitrile; acryl amides; vinyl ethers such as vinylmethylether, vinylethylether, and vinylisobutylether; monomers having a N-containing polar group such as N-vinyl compound including N-vinylpyrrole, N-vinylcarbazole, N-vinylindolel, or N-vinylpyrrolidone; vinyl carboxylic acids such as methacrylic acid, acrylic acid, cinnamic acid, or carboxyethyl acrylate; various polyesters, and the like. In addition, various waxes may also be used in combination therewith.

If the other resin is formed from a vinyl monomer, a resin particle dispersion thereof can be produced by emulsion polymerization in the presence of an ionic surfactant or the like. If the other resin is formed from monomers other than a vinyl monomer, a resin particle dispersion thereof can be produced by dissolving the resin in an oily solvent in a case when the resin is soluble to a solvent which is relatively insoluble in water, dispersing the solution together with an ionic surfactant or a polyelectrolyte by using a dispersing machine such as homogenizer into a particulate form in an aqueous medium, and then removing the solvent by heating or under reduced pressure.

When a constituent resin of the resin particles is amorphous, a glass transition point Tg thereof is in a range of approximately 50 to 80° C. and preferably of approximately 50 to 65° C. When the resin has a Tg of lower than approximately 50° C., it may cause deterioration of a cohesive force of the binder resin in a high-temperature range which may cause frequent hot offsetting during fixation, while when the resin has a Tg of higher than approximately 80° C., it may cause insufficient melting which may raise a lowest fixing temperature of the toner.

Alternatively, if the constituent resin for the resin particles is crystalline, a crystal melting point Tm of the resin is in a range of approximately 50 to 120° C. and preferably of approximately 55 to 90° C. When the resin has a Tm of lower than approximately 50° C., it may cause deterioration of a cohesive force of the binder resin in a high-temperature range, which may cause deterioration in releasing efficiency during fixation and more frequent hot offsetting. When the resin has a Tm of higher than approximately 120° C., it may cause insufficient melting, which may raise a lowest fixing temperature of the toner.

The average diameter of the resin particle is normally in a range of approximately 1 μm or less and preferably of approximately 0.01 to 1 μm. When the particles have an average diameter of larger than approximately 1 μm, it may tend to cause deterioration in the properties and the reliability of the toner because a particle diameter distribution of the resulting electrostatic image-developing toner expands and free particles are generated. On the other hand, when the particles have an average diameter of in the above range, it is advantageous since the particles carry none of the problems above, a difference of amounts of the resin particles contained each toner particles is reduced, the resin particles are more uniformly distributed in each toner particles, and smaller fluctuation in the properties and the reliability of the toner is thus achieved. The average diameter can be determined by using, for example, a coulter counter.

The mean diameter (median diameter) of the resin particles is in a range of approximately 1 μm or less, preferably of approximately 50 to 400 nm, and more preferably of approximately 70 to 350 nm. The mean diameter (median diameter) of the resin particles is determined by, for example, a laser diffraction particle size analyzer (trade name: LA-920 as described above).

Examples of the dispersion solvents for the resin particles include aqueous media and organic solvents. Examples of the aqueous media include water such as distilled water or ion-exchanged water, alcohols, and the like. These dispersion solvents may be used alone or in combination of two or more. The aqueous medium preferably contains a surfactant. The surfactant is not particularly limited, and examples thereof include anionic surfactants such as sulfate ester salts, sulfonic acid salts, phosphoric acid esters, or soaps; cationic surfactants such as amine salts or quaternary ammonium salts; nonionic surfactants such as polyethylene glycol, alkylphenol ethylene oxide adducts, or polyvalent alcohols; and the like. Among them, anionic surfactants and cationic surfactants are preferable. The nonionic surfactant is preferably used in combination with an anionic surfactant or cationic surfactant. The surfactants may be used alone or in combination of two or more.

Specific examples of the anionic surfactants include sodium dodecylbenzenesulfonate, sodium dodecylsulfate, sodium alkylnaphthalenesulfonates, sodium dialkylsulfosuccinates, and the like. Specific examples of the cationic surfactants include alkylbenzenedimethylammonium chlorides, alkyltrimethylammonium chlorides, distearylammonium chloride, and the like.

Examples of the organic solvents include ethyl acetate and toluene. The organic solvent is suitably selected according to the binder resin used.

When the resin particle is a vinyl resin, which is a homopolymer or copolymer of the ester monomers such as the esters having a vinyl group, vinyl nitriles, vinyl ethers, vinylketones or the like, a dispersion containing the homopolymer or copolymer of the vinyl monomer (vinyl resin) in a solvent containing an ionic surfactant is produced by, for example, an emulsion polymerization or seeding polymerization of the vinyl monomer in the solvent containing the ionic surfactant.

If the resin particle is a resin other than the homopolymer or copolymer of a vinyl monomer, a dispersion containing resin particles of the resin other than the vinyl resin in a solvent containing an ionic surfactant are produced by dissolving the resin in an oily solvent provided that the resin is soluble to a solvent which is relatively insoluble in water, dispersing the solution together with the ionic surfactant or a polyelectrolyte so as to form a particulate form in an aqueous medium by using a dispersing machine such as homogenizer, and distilling off the oily solvent by heating or under reduced pressure.

Alternatively, if the resin particle is a crystalline polyester or amorphous polyester resin, it is possible to produce an aqueous dispersion stabilized by an effect of an aqueous medium, in which the resin particles have a functional group that can become anionic form by neutralization, have a self-dispersibility in water, and have a part or all of hydrophilizable functional groups thereof that are neutralized with a base. In the crystalline polyester and amorphous polyester resin, the functional group that becomes hydrophilic by neutralization is an acidic group such as carboxylic acid or sulfonic acid group. Accordingly, utilizable examples of the neutralizing agents include inorganic bases such as sodium hydroxide, potassium hydroxide, lithium hydroxide, calcium hydroxide, sodium carbonate, or ammonia; organic bases such as diethylamine, triethylamine, or isopropylamine; and the like.

If a polyester resin which is indispersible in water, i.e., a non-self-water dispersible polyester resin, is used as the resin particle, it is possible to easily produce particles of approximately 1 μm or less by dispersing a resin solution and/or an aqueous medium miscible therewith together with a polyelectrolyte such as an ionic surfactant, polymeric acid, polymeric base, or the like; heating the mixture at a temperature of equal to or higher that a melting point of the resin; and processing the mixture under high shearing force by a homogenizer or high-pressure extrusion dispersing machine. The ionic surfactant or the polyelectrolyte is preferably added at a concentration of approximately 0.5 to 5 wt % in the aqueous medium when the ionic surfactant, the polymer electrolytes or the like are used.

The following colorants may be used as the colorant. Examples of black pigments include carbon black, copper oxide, manganese dioxide, aniline black, activated carbon, non-magnetic ferrite, magnetite, and the like.

Examples of yellow pigments include chrome yellow, zinc yellow, yellow iron oxide, cadmium yellow, chromium yellow, Hanza yellow, Hanza Yellow-10G, Benzidine Yellow G, Benzidine Yellow GR, threne yellow, quinoline yellow, Permanent Yellow NCG, and the like.

Examples of orange pigments include red chrome yellow, molybdenum orange, Permanent Orange GTR, pyrazolone orange, Vulcan orange, Benzidine Orange G; Indanthren Brilliant Orange RK, Indanthren Brilliant Orange GK, and the like.

Examples of red pigments include bengala, cadmium red, red lead, mercury sulfide, Watchung red, Permanent Red 4R, Lithol Red, Brilliant Carmine 3B, Brilliant Carmine 6B, Du Pont oil red, pyrazolone red, Rhodamine B Lake, Lake Red C, rose bengal, eoxine red, alizarin lake, and the like.

Examples of blue pigments include iron blue, cobalt blue, alkali blue lake, Victoria blue lake, Fast Sky Blue, Indanthren Blue BC, aniline blue, ultramarine blue, Calco Oil blue, methylene blue chloride, phthalocyanine blue, phthalocyanine green, malachite green oxalate, and the like.

Examples of purple pigments include manganese purple, Fast Violet B, methyl violet lake, and the like.

Examples of green pigments include chromium oxide, chromium green, pigment green, malachite green lake, Final Yellow Green G, and the like.

Examples of white pigments include zinc white, titanium oxide, antimony white, zinc sulfide, and the like.

Examples of extender pigments include baryte powders, barium carbonate, clay, silica, white carbon, talc, alumina white, and the like.

Further, examples of dyes include various dyes including basic dyes, acidic dyes, dispersion dyes, and direct dyes, and specific examples thereof include nigrosin, methylene blue, rose bengal, quinoline yellow, ultramarine blue, and the like.

These colorants may be used alone or in combination. Dispersions of particles of the colorant may be prepared by: a dispersing machine such as a dispersing machine containing a dispersing medium such as a rotary shearing homogenizer, ball mill, sand mill, or attritor; a high-pressure counter-collision dispersing machine; or the like. Alternatively, these colorants may be dispersed in water in a presence of a surfactant having a polarity by a homogenizer.

The colorants are suitably selected from the viewpoints of hue angle, color saturation, brightness, weather resistance, over head projector (OHP) transparency, and dispersibility.

The colorant may be added in an amount in the range of 4 to 15% by weight with respect to the total weight of the solid contents in the toner. Exceptionally, when magnetic particles are used as the black colorant, the magnetic particles may be added in an amount of 12 to 50% by weight with respect to the total weight of the solid contents in the toner.

The colorant is necessarily compounded in an amount that ensures color density at the time when the toner is fixed. In addition, an OHP transparency and color density of formed images can be ensured by adjusting an average diameter (median diameter) of the colorant particles in the toner in a range of about 100 to 330 nm.

The mean diameter (median diameter) of colorant particles can be determined by, for example, a laser-diffraction grain size distribution analyzer (trade name: LA-920 as described above).

When the toner according to the invention is used as a magnetic toner, a magnetic powder may be added thereto. Specifically, a material magnetized in magnetic field is used, and examples thereof include ferromagnetic powders of iron, cobalt, nickel, and the like; compounds such as ferrite, magnetite, and the like. When the toners are prepared in an aqueous phase, care should be given to migration of the magnetic material into the aqueous phase. It is preferable to modify the surface of the magnetic material in advance by, for example, a hydrophobilization treatment.

In addition, internal additives, such as a magnetic material selected from the group consisting of metals such as ferrite, magnetite, reduced iron, cobalt, nickel, or manganese, alloys thereof, or compounds containing these metals. An antistatic agent, which is selected from the group consisting of various commonly used antistatic agents such as quaternary ammonium salts, nigrosin compounds, dyes prepared from complexes of aluminum, iron or chromium, or triphenylmethane pigments, may also be used as an internal additives. From viewpoints of controlling an ionic strength, which may affects the efficiency of the coagulation and fusion in coagulating, and reducing wastewater pollution, the internal additives are preferably materials which are less soluble in water.

Specific examples of the releasing agents include various ester waxes; low molecular weight polyolefins such as polyethylene, polypropylene, or polybutylene; silicones which exhibit softening points by heating; aliphatic acid amides such as oleic amide, erucic acid amide, ricinolic acid amide, or stearic acid amide; vegetable waxes such as carnauba wax, rice wax, candelilla wax, Japan tallow, and jojoba oil; animal waxes such as beeswax; mineral-petroleum waxes such as montan wax, ozokerite, ceresin, paraffin wax, microcrystalline wax, or Fischer-Tropsch wax; modified materials thereof; and the like.

These waxes are hardly or scarcely soluble in solvents such as toluene at around room temperature.

A dispersion containing particles of approximately 1 μm or less can be produced by dispersing these waxes together with a polymer electrolyte such as an ionic surfactant, a polymeric acid or polymeric base, heating the dispersion at a temperature higher than a melting point of the waxes together with dispersing in a dispersion state by using high shearing force by a homogenizer or high-pressure extrusion dispersing machine (trade name: GAULIN HOMOGENIZER, manufactured by APV Gaulin).

A releasing agent is preferably added in an amount of about 5 to 25 wt % with respect to the total amount of solid components of the toner for ensuring a releasability of a fixed image in oilless fusing systems.

The particle diameter of the releasing agent particles in dispersion can be determined by, for example, a laser diffraction particle size analyzer (trade name: LA-920 as described above). If the releasing agent is used, in view of ensuring suitable electrostatic properties and durability of the particles, it is preferable to firstly aggregate resin particles, colorant particles and releasing agent particles, and then further add a resin dispersion so as to attach the resin particles to surfaces of the aggregate particles.

The cumulative volume average diameter $D_{50}$ of the toner produced by the method of producing electrostatic image-developing toner according to the invention is in a range of approximately 3.0 to 9.0 μm, preferably of approximately 3.0 to 5.0 μm. When the toner has a $D_{50}$ of less than approximately 3.0 μm, it may cause increase in adhesive force and thus deterioration in printing efficiency occurs. When the toner has a $D_{50}$ of more than approximately 9.0 μm, it may cause deterioration in image resolution.

The volume-average grain size distribution index (GSDv) of the obtained toner is preferably approximately 1.30 or less. When the toner has a GSDv of more than approximately 1.30, it may result in deterioration in resolution and may cause scattering of the toner and image defects such as high background soil.

For determination of the cumulative volume average diameter $D_{50}$ and the average grain size distribution index, a cumulative distribution curve is drawn from the smaller side, by using the volume and the number of toner particles classified according to grain ranges (channel) partitioned based on the grain size distribution, as determined for example by an analyzer such as COULTER COUNTER® TAII (manufactured by Beckmann Coulter) or Multisizer II™ (manufactured by Beckmann Coulter); and the particle diameters at a cumulative count of 16% are defined as $D_{16v}$ and $D_{16p}$, the particle diameters at a cumulative count of 50%, $D_{50v}$, and $D_{50p}$, and those of 84%, $D_{84v}$ and $D_{84p}$. The volume-average grain size distribution index (GSDv) is calculated as $(D_{84v}/D_{16v})^{1/2}$, and the number-averaged particle diameter distribution index (GSDp) is calculated as $(D_{84p}/D_{16p})^{1/2}$ by using these values.

The shape factor SF1 of the toner obtained is in a range of approximately 100 to 140, preferably of approximately 110 to 135 from a viewpoint of image-forming properties. The shape factor SF1 is determined as follows: The toner shape factor SF1 is determined by incorporating optical microscope images of the toner particles spread on a slide glass via a video camcorder into a Luzex image-analyzing instrument; measuring the perimeters (ML) and the projection areas (A) of 50 or more toner particles; and a value calculated as $ML^2/A$ (=Perimeter$^2$/Projection area) is defined as the shape factor SF1.

For the purpose of imparting fluidity and improving cleanability, the obtained toner may be dried in a similar manner as to common toners and then may be added with inorganic particles such as silica, alumina, titania, or calcium carbonate, or a resin particle such as vinyl resin particles, polyester particles, silicone particles, or the like under a shear force in a dried state.

When inorganic particles are adhered on the toner surface in an aqueous medium for the purpose of imparting fluidity and improving cleanability, examples of the inorganic particles include all external additives commonly used as for toner surface such as silica, alumina, titania, calcium carbonate, magnesium carbonate, tricalcium phosphate, or the like, and the inorganic particle can be used in a dispersed state together with an ionic surfactant, a polymeric acid or a polymeric base.

The toner obtained according to the method of producing electrostatic image-developing toner of the invention described above is used as an electrostatic developer. The developer is not particularly limited provided that it contains the electrostatic image-developing toner according to the invention, and may have any composition according to its application object. The electrostatic image-developing toner is produced as a one-component electrostatic image developer when used alone, and as a two-components electrostatic image developer when used in combination with a carrier.

In addition, the electrostatic developer (electrostatic image-developing toner) can be used in common image-forming processes of electrostatic image developing methods (electrophotographic methods). Specifically, the image-forming process according to the invention includes, for example, an electrostatic latent image-forming process, a toner image-forming process, a transferring process, and a cleaning process. Each of the processes is a general process, and described, for example, in JP-A Nos. 56-40868 and 49-91231 and others. The image-forming method according to the invention can be implemented by using conventionally-known image-forming apparatuses such as copying machines, facsimiles or the like. The electrostatic latent image-forming process is a process of forming an electrostatic latent image on an electrostatic latent image carrier. The toner image-forming process is a process of developing the electrostatic latent image and thus forming a toner image by a developer layer on the developer carrier. The developer layer is not particularly limited provided that it contains the electrostatic image developer according to the invention that contains the electrostatic image-developing toner according to the invention. The transferring process is a process of transferring the toner image onto a transfer body. The cleaning process is a process of removing the electrostatic image developer that remains on the electrostatic latent image carrier. In the image-forming process according to the invention, an embodiment which further includes a recycle process is preferable. The recycle process is a process of feeding the electrostatic image-developing toner recovered in the cleaning process back to the developer layer. The image-forming process according to the embodiment which includes the recycle process can be performed in toner-recycling image-forming apparatuses such as copying machines or facsimiles. The image-forming process can also be applied to recycling systems which have no cleaning process and recover toner during development.

Hereinafter, particularly preferable embodiments of the invention will be listed, but it should be understood that the invention is not restricted to the following embodiments.

(1) A resin particle dispersion for an electrostatic image-developing toner containing polycondensation resin particles, wherein the polycondensation resin particles are prepared by polycondensation of polycondensable monomers in an aqueous medium and have a median diameter of approximately 0.05 to 2.0 μm.

(2) The resin particle dispersion of (1), wherein the polycondensation resin particles are crystalline and a crystal melting point thereof is approximately 50° C. to approximately 120° C.

(3) The resin particle dispersion of (1) or (2), wherein the polycondensation resin particles are non-crystalline and a glass transition point thereof is approximately 50° C. to approximately 80° C.

(4) The resin particle dispersion of any one of (1) to (3), wherein the polycondensable monomer contains at least a polyvalent carboxylic acid and a polyol.

(5) The resin particle dispersion of any one of (1) to (4), wherein the polycondensable monomer is polycondensed in a presence of an acid having surfactant properties as a polycondensation catalyst.

(6) The resin particle dispersion of any one of (1) to (5), wherein the polycondensable monomer is polycondensed in a presence of a rare-earth metal-containing catalyst as a polycondensation catalyst.

(7) The resin particle dispersion of any one of (1) to (6), wherein the polycondensable monomer is polycondensed in a presence of a hydrolytic enzyme as a polycondensation catalyst.

(8) The resin particle dispersion of any one of (1) to (7), wherein the median diameter is approximately 0.1 to 1.5 μm.

(9) The resin particle dispersion of any one of (1) to (8), wherein the median diameter is approximately 0.1 to 1.0 μm.

(10) The resin particle dispersion of any one of (1) to (9), wherein a weight ratio of the polycondensation resin particles that have a median diameter of approximately 0.03 μm or less is approximately 10% or less relative to a total weight of the polycondensation resin particles, and a weight ratio of the polycondensation resin particles that have a median diameter of approximately 5.0 μm or more in the dispersion is approximately 10% or less relative to the total weight of the polycondensation resin particles.

(11) The resin particle dispersion of any one of (1) to (10), wherein a weight ratio of the polycondensation resin particles that have a median diameter of approximately 0.03 μm or less in the dispersion is approximately 5% or less relative to a total weight of the polycondensation resin particles, and a weight ratio of the polycondensation resin particles that have a median diameter of approximately 5.0 μm or more in the dispersion is approximately 5% or less relative to the total weight of the polycondensation resin particles.

(12) A method of producing electrostatic image-developing toners, including:

dispersing resin particles so as to obtain a resin particle dispersion;

aggregating the resin particles in the resin particle dispersion so as to obtain aggregated particles; and coalescing the aggregated particles by heating, wherein the resin particle dispersion is the resin particle dispersion for an electrostatic image-developing toner of any one of (1) to (11).

(13) The method of (12), wherein dispersing the resin particles includes:

first emulsifying or dispersing of a mixture of the polycondensable monomers and the aqueous medium so as to obtain an emulsion dispersion; and second agitating of the emulsion dispersion so as to obtain a microparticle emulsion dispersion.

(14) The method of (13), wherein an oily solution, that is obtained by mixing and melting the polycondensable monomers with an additive, is mixed with the aqueous medium so as to obtain the mixture, and the median diameter is approximately 0.1 to 1.0 μm.

(15) The method of (14), wherein the oily solution is mixed with the aqueous medium that is previously heated, so as to obtain the mixture.

(16) The method of (14) or (15), wherein the oily solution is mixed with the aqueous medium together with a solvent so as to obtain the mixture, and wherein the method further includes removing the solvent from the microparticle emulsion dispersion by stirring and heating the microparticle emulsion dispersion.

(17) The method of any one of (13) to (16), wherein the first emulsifying or dispersing includes:

emulsifying or dispersing and emulsifying an oily solution, that is obtained by mixing and melting the polycondensable monomers with an additive, while gradually adding the aqueous medium that is previously heated; and subjecting a resultant of the emulsifying or dispersing and emulsifying to a phase inversion emulsification by further addition of the aqueous medium, and wherein the median diameter is approximately 0.1 to 1.0 μm.

(18) An electrostatic image-developing toner obtained by the method of any one of (12) to (17).

(19) The electrostatic image-developing toner of (18), wherein a cumulative volume average diameter of the electrostatic image-developing toner is approximately 3.0 to 5.0 μm.

(20) A condensation compound particle dispersion for an electrostatic image-developing toner containing condensation compound particles, wherein the condensation compound particles are prepared by dehydration condensation of a condensable compound in an aqueous medium and have a median diameter of approximately 0.05 to 2.0 μm.

(21) The condensation compound particle dispersion of (20), wherein the condensation compound particles are crystalline and a crystal melting point thereof is approximately 50° C. to 120° C.

(22) The condensation compound particle dispersion of (20) or (21), wherein the polycondensable monomer contains at least a polyvalent carboxylic acid and a polyol.

(23) The condensation compound particle dispersion of any one of (20) to (22), wherein the condensable compound is dehydration-condensed in a presence of an acid having surfactant properties as a dehydration condensation catalyst.

(24) The condensation compound particle dispersion of any one of (20) to (23), wherein the condensable compound is dehydration-condensed in a presence of a rare-earth metal-containing catalyst as a dehydration condensation catalyst.

(25) The condensation compound particle dispersion of any one of (20) to (24), wherein the condensable compound is dehydration-condensed in a presence of a hydrolytic enzyme as a dehydration condensation catalyst.

(26) The condensation compound particle dispersion of any one of (20) to (25), wherein the median diameter is approximately 0.1 to 1.5 μm.

(27) The condensation compound particle dispersion of any one of (20) to (26), wherein the median diameter is approximately 0.1 to 1.0 μm.

(28) The condensation compound particle dispersion of any one of (20) to (27), wherein a weight ratio of the condensation compound particles that have a median diameter of approximately 0.03 μm or less in the dispersion is approximately 10% or less relative to a total weight of the condensation compound particles, and a weight ratio of the condensation compound particles that have a median diameter of approximately 5.0 μm or more in the dispersion is approximately 10% or less relative to a total weight of the condensation compound particles.

(29) The condensation compound particle dispersion of any one of (20) to (28), wherein a weight ratio of the condensation compound particles that have a median diameter of approximately 0.03 μm or less in the dispersion is approximately 5% or less relative to a total weight of the condensation compound particles, and a weight ratio of the condensation compound particles that have a median diameter of approximately 5.0 μm or more in the dispersion is approximately 5% or less relative to a total weight of the condensation compound particles.

(30) A method of producing electrostatic image-developing toners, including:

dispersing resin particles so as to obtain a resin particle dispersion;

dispersing condensation compound particles so as to obtain a condensation compound particle dispersion;

aggregating the resin particles and the condensation compound particles in a mixture dispersion, obtained by mixing the resin particle dispersion and the condensation compound particle dispersion, so as to obtain aggregated particles; and coalescing the aggregated particles by heating, wherein the condensation compound particle dispersion is the condensation compound particle dispersion of any one of (20) to (29).

(31) The method of (30), wherein dispersing the condensation compound particles includes:

first emulsifying or dispersing of a mixture of the condensable compound and the aqueous medium so as to obtain an emulsion dispersion; and second emulsifying or dispersing of the emulsion dispersion so as to obtain a microparticle emulsion dispersion.

(32) The method of (31), wherein an oily solution, that is obtained by mixing and melting the condensable compound with an additive, is mixed with the aqueous medium so as to obtain the mixture, and the median diameter is approximately 0.1 to 1.0 μm.

(33) The method of (32), wherein the oily solution is mixed with the aqueous medium that is previously heated, so as to obtain the mixture.

(34) The method of (32) or (33), wherein the oily solution is mixed with the aqueous medium together with a solvent so as to obtain the mixture, and wherein the method further includes removing the solvent from the microparticle emulsion dispersion by stirring and heating the microparticle emulsion dispersion.

(35) The method of any one of (31) to (34), wherein the first emulsifying or dispersing comprises:

emulsifying or dispersing and emulsifying an oily solution, that is obtained by mixing and melting the condensable compound with an additive, while gradually adding the aqueous medium that is previously heated; and subjecting a resultant of the emulsifying or dispersing and emulsifying to a phase inversion emulsification by further addition of the aqueous medium, and wherein the median diameter is approximately 0.1 to 1.0 μm.

(36) An electrostatic image-developing toner obtained by the method of any one of (30) to (35).

(37) The electrostatic image-developing toner of (36), wherein a cumulative volume average diameter of the electrostatic image-developing toner is approximately 3.0 to 5.0 μm.

EXAMPLES

Hereinafter, the present invention will be described in detail with reference to examples, but the invention is not restricted thereto at all.

In the Examples below, the particle dispersions, colorant particle dispersions, and releasing agent particle dispersions below are respectively prepared. Aggregate particles are prepared by stirring the mixture of these dispersions at a certain ratio and ionically neutralizing the particles by addition of a polymer of metal salt. The particles are then added with an inorganic hydroxide for adjusting a pH of the system from weakly acidic to neutral, and coalesced by heating to a temperature of a glass transition point of the resin particles or more. After the above reaction is finished, sufficient washing, solid-liquid separation, and drying are conducted so as to obtain aimed toners. Hereinafter, methods of preparing respective dispersions will be described.

Preparation of Resin Particle Dispersion 1-(1)

Dodecylbenzenesulfonic acid: 36 parts by weight 1,9-Nonanediol: 80 parts by weight 1,10-Decamethylenedicarboxylic acid: 115 parts by weight Ion-exchanged water: 1,000 parts by weight First, dodecylbenzenesulfonic acid, 1,9-nonanediol, and 1,10-decamethylenedicarboxylic acid in the above composition are mixed and heated to approximately 120° C. so as to fuse them to obtain an oily solution. The oily solution is poured into ion-exchanged water which is previously heated at approximately 95° C., and the resulting mixture is immediately emulsified by using a homogenizer (ULTRA-TURRAX® T50, manufactured by IKA® Works, Inc.) for approximately 5 minutes. Then, the emulsion is further emulsified in a supersonic wave bath for approximately 5 minutes, and the emulsified mixture is kept in a flask at approximately 70° C. for approximately 15 hours while it is stirred.

In this manner, a crystalline polyester resin particle dispersion 1-(1) having a mean particle diameter (median diameter) of approximately 400 nm, a melting point of approximately 70° C., a weight-average molecular weight of approximately 5,500, and a solid content of approximately 18% is obtained.

With regard to the particles in the resin particle dispersion 1-(1), a ratio of a weight of the particles having a median diameter of approximately 0.03 μm or less or approximately 5.0 μm or more relative to a total weight of the particles in the resin particle dispersion (hereinafter, referred to as a "ratio of larger and smaller particles relative to all particles") is approximately 1.2%.

Preparation of Resin Particle Dispersion 1-(2)

Dodecylbenzenesulfonic acid: 36 parts by weight 1,6-Hexanediol: 59 parts by weight Sebacic acid: 101 parts by weight Ion-exchanged water: 1,000 parts by weight First, dodecylbenzenesulfonic acid, 1,6-hexanediol, and sebacic acid in the above composition are mixed and fused by heating the mixture to approximately 140° C. so as to fuse them to obtain an oily solution. The oily solution is poured into ion-exchanged water which is previously heated at approximately 95° C., and the resulting mixture is immediately emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 70° C. for approximately 15 hours while it is stirred.

In this manner, a crystalline polyester resin particle dispersion 1-(2) having a mean particle diameter (median diameter) of approximately 720 nm, a melting point of approximately 69° C., a weight-average molecular weight of approximately 4,500, and a solid content of approximately 16% is prepared.

The ratio of larger and smaller particles relative to all particles in the particles of the resin particle dispersion 1-(2) is approximately 4.4%.

Preparation of Resin Particle Dispersion 1-(3)

Dodecyl sulfuric acid: 30 parts by weight 1,9-Nonanediol: 80 parts by weight

Azelaic acid: 94 parts by weight

Ion-exchanged water: 1,000 parts by weight

First, dodecylbenzenesulfonic acid, 1,9-hexanediol, and azelaic acid in the above composition are mixed and fused by heating the mixture to approximately 110° C. so as to fuse them to obtain an oily solution. The oily solution is poured into ion-exchanged water which is previously heated at approximately 95° C., and the resulting mixture is immediately emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 70° C. for approximately 15 hours while it is stirred.

In this manner, a crystalline polyester resin particle dispersion 1-(3) having a mean particle diameter (median diameter) of approximately 220 nm, a melting point of approximately 55° C., a weight-average molecular weight of approximately 7,500, and a solid content of approximately 17% is prepared.

The ratio of larger and smaller particles relative to all particles in the particles of the resin particle dispersion 1-(3) is approximately 0.5%.

Preparation of Resin Particle Dispersion 1-(4)

Isopropylbenzenesulfonic acid: 25 parts by weight

Terephthalic acid: 46 parts by weight

Polyoxyethylene (2,4)-2,2-bis(4-hydroxyphenyl)propane: 34 parts by weight

Ethylene glycol: 20 parts by weight

Ion-exchanged water: 500 parts by weight

Isopropylbenzenesulfonic acid, terephthalic acid, polyoxyethylene (2,4)-2,2-bis(4-hydroxyphenyl)propane, and ethylene glycol in the above composition are mixed and fused by heating the mixture to approximately 110° C. so as to fuse them to obtain an oily solution. The oily solution is poured into ion-exchanged water which is previously heated at approximately 95° C., and the resulting mixture is immediately emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 90° C. for approximately 20 hours while it is stirred.

In this manner, a crystalline polyester resin particle dispersion 1-(4) having a mean particle diameter (median diameter) of approximately 520 nm, a glass transition point of approximately 55° C., a weight-average molecular weight of approximately 4,500, and a solid content of approximately 14% is prepared.

The ratio of larger and smaller particles relative to all particles in the particles of the resin particle dispersion 1-(4) is approximately 2.3%.

Preparation of Resin Particle Dispersion 15) by Using Rare-earth Metal Catalyst

Scandium dodecylbenzenesulfonate (rare-earth metal-containing catalyst): 36 parts by weight 1,9-Nonanediol: 80 parts by weight 1,10-Decamethylenedicarboxylic acid: 115 parts by weight Ion-exchanged water: 1,000 parts by weight Scandium dodecylbenzenesulfonate (rare-earth metal-containing catalyst), 1,9-nonanediol, and 1,10-decamethylenedicarboxylic acid in the above composition are mixed and fused by heating the mixture to approximately 120° C. so as to fuse them to obtain an oily solution. The oily solution is poured into ion-exchanged water which is previously heated at approximately 95° C., and the resulting mixture is immediately emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 80° C. for approximately 15 hours while it is stirred.

In this manner, a crystalline polyester resin particle dispersion 1-(5) having a mean particle diameter (median diameter) of approximately 370 nm, a melting point of approximately 70° C., a weight-average molecular weight of approximately 4,900, and a solid content of approximately 18% is prepared.

The ratio of larger and smaller particles relative to all particles in the particles of the resin particle dispersion 1-(5) is approximately 1.8%.

Preparation of Resin Particle Dispersion 1-(6) by Using Enzyme Catalyst

Dodecylbenzenesulfonic acid: 12 parts by weight

Lipase (enzyme catalyst derived of *Pseudomonas* species): 50 parts by weight 1,9-Nonanediol: 80 parts by weight 1,10-Decamethylenedicarboxylic acid: 115 parts by weight Ion-exchanged water: 1,000 parts by weight First, dodecylbenzenesulfonic acid, lipase, 1,9-nonanediol, and 1,10-decamethylenedicarboxylic acid in the above composition are mixed and fused by heating the mixture to approximately 120° C. so as to fuse them to obtain an oily solution. The oily solution is poured into ion-exchanged water which is previously heated at approximately 85° C., and the resulting mixture is immediately emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 80° C. for approximately 15 hours while it is stirred.

In this manner, a crystalline polyester resin particle dispersion 1-(6) having a mean particle diameter (median diameter) of approximately 1,070 mm, a melting point of approximately 69° C., a weight-average molecular weight of approximately 4,500, and a solid content of approximately 20% is prepared.

The ratio of larger and smaller particles relative to all particles in the particles of the resin particle dispersion 1-(6) is approximately 8.8%.

Preparation of Resin Particle Dispersion 1-(7): Comparative Example

Dodecylbenzenesulfonic acid: 18 parts by weight 1,9-Nonanediol: 80 parts by weight, 1,10-Decamethylenedicarboxylic acid: 115 parts by weight Ion-exchanged water: 1,000 parts by weight First, 1,9-nonanediol and 1,10-decamethylenedicarboxylic acid in the composition above are mixed and fused by heating the mixture to approximately 120° C. Then, the thus obtained solution is poured into ion-exchanged water at room temperature. Then, the resulting mixture is emulsified by using a homogenizer (ULTRA-TURRAX® T50, described above) for approximately 1 minute. Then, the emulsion is kept in a flask at approximately 60° C. for approximately 15 hours while it is stirred.

In this manner, a crystalline polyester resin particle dispersion 1-(7) having a mean particle diameter (median diameter) of approximately 2,100 nm, a melting point of approximately 69° C., a weight-average molecular weight of approximately 3,500, and a solid content of approximately 18% is prepared.

The ratio of larger and smaller particles relative to all particles in the particles of the resin particle dispersion 1-(7) is approximately 10.8%.

Preparation of Resin Particle Dispersion 1-(8): Comparative Example

Dodecylbenzenesulfonic acid: 36 parts by weight 1,4 Butanediol: 45 parts by weight Azelaic acid: 94 parts by weight Ion-exchanged water: 1,000 parts by weight Azelaic acid and 1,4 butanediol in the composition above are mixed and fused by heating the mixture to approximately 110° C. Then, the thus obtained solution is poured into ion-exchanged water which is previously heated at approximately 95° C. Then, the resulting mixture is emulsified by using a homogenizer (ULTRA-TURRAX® T50, described above) for approximately 5 minute. Then, the emulsion is further emulsified in a supersonic wave bath for approximately 30 minutes, and the emulsified mixture is kept in a flask at approximately 70° C. for approximately 15 hours while it is stirred.

In this manner, a crystalline polyester resin particle dispersion 1-(8) having a mean particle diameter (median diameter) of approximately 25 nm, a melting point of approximately 48° C., a weight-average molecular weight of approximately 6,500, and a solid content of approximately 15% is prepared.

The ratio of larger and smaller particles relative to all particles in the particles of the resin particle dispersion 1-(8) is approximately 12%.

Preparation of Resin Particle Dispersion 1-(9): Non-crystalline Vinyl Resin Latex Styrene: 460 parts by weight n-Butyl acrylate: 140 parts by weight Acrylic acid: 12 parts by weight Dodecanethiol: 9 parts by weight Respective components in the above composition are mixed and dissolved to provide a solution. Separately, approximately 12 parts by weight of an anionic surfactant (DOWFAX™, manufactured by Dow Chemical Company) is dissolved in approximately 250 parts by weight of ion-exchanged water, and the above solution is added thereto to provide a mixture. The mixture is dispersed and emulsified in a flask (monomer emulsion A). In addition, a solution of approximately 1 parts by weight of the same anionic surfactant (DOWFAX™, described above) in approximately 555 parts by weight of ion-exchanged water is placed in a polymerization flask. The polymerization flask is then tightly sealed, gradually heated to approximately 75° C. in a water bath, and kept at the same temperature, while the solution is gently stirred under reflux with an introduction of nitrogen gas.

Then, a solution of approximately 9 parts by weight of ammonium persulfate dissolved in approximately 43 parts by weight of ion-exchanged water is dropwisely added into the polymerization flask via a constant volume supply pump over a period of approximately 20 minutes, and then the monomer emulsion A is also added dropwise via a constant volume pump over a period of approximately 200 minutes.

Then, the mixture is kept at approximately 75° C. in the polymerization flask while gently stirred for approximately 3 hours, to complete polymerization.

In this manner, an anionic resin particle dispersion 1-(9) having a mean particle diameter (median diameter) of approximately 210 nm, a glass transition point of approximately 53.5° C., a weight-average molecular weight of approximately 31,000, and a solid content of approximately 42% is prepared.

The ratio of larger and smaller particles relative to all particles in the particles of the resin particle dispersion 1-(9) is approximately 0.2%.

Preparation of Resin Particle Dispersion 1-(10)

Approximately 0.05 mol % of dibutyltin oxide is added to a mixture of approximately 40 parts by weight of 1,9-nonanediol and approximately 57.5 parts by weight of 1,10-decamethylenedicarboxylic acid. The thus obtained mixture is agitated in a flask equipped with an emulsifying or dispersing blade and heated to approximately 200° C. so as to proceed polymerization under a reduced pressure for 6 hours to give a crystalline polyester resin having a weight-average molecular weight of approximately 6,200, and a melting point of approximately 69° C. Approximately 460 g of ion-exchanged water containing approximately 3.2 g of sodium dodecylbenzenesulfonate is added to approximately 80 g of the resin. The thus obtained mixture is heated to approximately 140° C. under pressure in a stainless flask and emulsified at the same time by a homogenizer (ULTRA-TURRAX® T50, described above) for approximately 1 hour so as to give a crystalline polyester resin particle dispersion.

In this manner, a resin particle dispersion 1-(10) having a mean particle diameter (median diameter) of approximately 450 nm, a melting point of approximately 69° C., and a solid content of approximately 15% is prepared.

The ratio of larger and smaller particles relative to all particles in the particles of the resin particle dispersion 1-(10) is approximately 4.5%.

Preparation of Colorant Particle Dispersion 1-(1)

Yellow pigment (trade name: Y74, manufactured by Dainichiseika Color & Chemicals Mfg. Co., Ltd.): 50 parts by weight Anionic surfactant (trade name: NEOGEN R, manufactured by Daiichi Kogyo Seiyaku Co., Ltd.): 5 parts by weight Ion-exchanged water: 200 parts by weight Respective components in the above composition are mixed and dissolved and dispersed by a homogenizer (ULTRA-TURRAX® T50, described above) for approximately 5 min and then by a supersonic wave bath for approximately for 10 minutes, to give an yellow particle dispersion 1-(1) having a mean diameter (median diameter) of approximately 240 nm and a solid content of approximately 21.5%.

Preparation of Colorant Particle Dispersion 1-(2)

A cyan colorant particle dispersion 1-(2) having a mean diameter (median diameter) of approximately 190 nm and a solid content of approximately 21.5% is prepared in a similar manner as for the colorant particle dispersion 1-(1), except that a cyan pigment (trade name: COPPER PHTHALOCYANINE B15:3, manufactured by Dainichiseika Color & Chemicals Mfg. Co., Ltd.) is used instead of the yellow pigment used in preparation of the colorant particle dispersion 1-(1).

Preparation of Colorant Particle Dispersion 1-(3)

A colorant particle dispersion 1-(3) having a mean diameter (median diameter) of approximately 165 nm and a solid content of approximately 21.5% is prepared in a similar manner as for the colorant particle dispersion 1-(1), except that a magenta pigment (trade name: PR122, manufactured by Dainippon Ink and Chemicals, Inc.) is used instead of the yellow pigment used in preparation of the colorant particle dispersion 1-(1).

Preparation of Colorant Particle Dispersion 1-(4)

A colorant particle dispersion 1-(4) having a mean diameter (median diameter) of approximately 170 nm and a solid content of approximately 21.5% is prepared in a similar manner as for the colorant particle dispersion 1-(1), except that a black pigment (trade name: CARBON BLACK, manufactured by Cabot Corporation) is used instead of the yellow pigment used in the preparation of the colorant particle dispersion 1-(1).

Preparation of Releasing Agent Particle Dispersion

Paraffin wax (trade name: HNP 9, manufactured by Nippon Seiro Co., Ltd.: melting point: 70° C.): 50 parts by weight Anionic surfactant (DOWFAX™, described above): 5 parts by weight Ion-exchanged water: 200 parts by weight A mixture of the respective components in the above composition is heated to approximately 95° C. and thoroughly dispersed by using a homogenizer (ULTRA-TURRAX® T50, manufactured by IKA® Works, Inc.) and additionally dispersed by using a high-pressure extrusion homogenizer (trade name: GAULIN HOMOGENIZER, manufactured by APV Gaulin) to give a releasing agent particle dispersion having a mean diameter (median diameter) of approximately 180 nm and a solid content of approximately 21.5%.

Toner Example 1-1

Preparation of Toner Particle

Resin particle dispersion 1-(1): 233 parts by weight (resin: 42 parts by weight)

Resin particle dispersion 1-(9): 50 parts by weight (resin: 21 parts by weight)

Colorant particle dispersion 1-(1): 40 parts by weight (pigment: 8.6 parts by weight)

Releasing agent particle dispersion: 40 parts by weight (releasing agent: 8.6 parts by weight)

Polyaluminum chloride: 0.15 weight part

Ion-exchanged water: 300 parts by weight

A mixture of the respective components in the above composition (except for the resin particle dispersion 1-(9)) is thoroughly dispersed in a circular stainless steel flask by using a homogenizer (ULTRA-TURRAX®T50, described above) and then heated to approximately 42° C. and kept at the same temperature for approximately 60 minutes in a heated oil bath while it is stirred; then, approximately 50 parts by weight of the resin particle dispersion 1-(9) (resin: approximately 21 parts by weight) is added thereto, and the mixture is stirred gently.

A pH of the mixture is then adjusted to approximately 6.0 by adding an aqueous sodium hydroxide solution of approximately 0.5 mole/liter, and heated to approximately 95° C. while stirred. The pH of the mixture, which normally decreases to approximately 5.0 or less during heating at approximately 95° C., is adjusted so as not to decrease to approximately 5.5 or less with dropwise addition of an aqueous sodium hydroxide solution.

After reaction, the mixture is cooled and filtered. The filter cake is thoroughly washed in ion-exchanged water and filtered through a Nutsche filter under reduced pressure for solid-liquid separation. The filter cake is then redispersed in approximately 3 liter of ion-exchanged water at approximately 40° C., and the dispersion is stirred and washed at a stirring speed of approximately 300 rpm for approximately 15 minutes. The washing and filtration through the Nutsche filtration under reduced pressure is repeated five times, and then the solid is dried under vacuum for approximately 12 hours so as to give toner particles.

The cumulative volume average diameter $D_{50}$ of the toner particles, as determined in a coulter counter, is approximately 4.6 μm, and the volume-average grain size distribution index GSDv thereof is approximately 1.20. In addition, the toner particles have a potato-like shape and the shape factor SF1 of the toner particles as determined by observation using Luzex is 130.

A mixture of approximately 50 parts by weight of the toner particle and approximately 1.2 parts by weight of hydrophobic silica (trade name: TS720, manufactured by Cabot Corporation) is blended in a sample mill so as to give an external additive toner.

Then, a ferrite carrier having an average diameter of approximately 50 μm coated with polymethyl methacrylate (manufactured by Soken Chemical & Engineering Co., Ltd.) at a concentration of approximately 1% and the external additive toner in an amount of approximately 5% as toner concentration are stirred by a ball mill for approximately 5 minutes so as to give a developer.

Evaluation of Toner

Fixing properties of the toner evaluated by using the above developer and a transfer paper (trade name: J Coated Paper, manufactured by Fuji Xerox Co., Ltd.) in a modified printing machine (trade name: DOCUCENTER COLOR500, manufactured by Fuji Xerox Co., Ltd.) at a processing speed of approximately 180 mm/sec reveal that an oilless fixing property on a perfluoroalkoxy (PFA) tube fixing roll is favorable, a lowest fixing temperature (which is separately determined by image staining resulting from a test of cloth-wiping of image) thereof is approximately 120° C. or more, images are sufficiently fixed, and the transfer papers are released without any resistance. The surface glossiness of the image formed at the fixing temperature of approximately 140° C. is favorable at approximately 65%. Both of the developing property and the transfer property are favorable. The toner gives favorable high-quality images (grade B) without image defects. No hot offsetting is observed even at a fixing temperature of approximately 200° C.

A stability of the resin particle dispersion 1-(1) before preparation of the toner is evaluated by a shear-homogenizing method, namely, a method of placing approximately 100 g of the resin particle dispersion in a 300-ml stainless beaker, homogenizing the dispersion under shear in the beaker by using a homogenizer (ULTRA-TURRAX® T50, described above) approximately for 1 minutes, filtering the resin particle dispersion through a 77-micron nylon mesh, and observing a presence or absence of aggregates, which results in generation of no aggregates, indicating that the dispersion has stability (grade A).

Toner Example 1-2

Toner particles are prepared in a similar manner as in Example 1-1, except that the resin particle dispersion 1-(1) in Example 1-1 is replaced with the resin particle dispersion 1-(2), the colorant particle dispersion 1-(1) is replaced with the colorant particle dispersion 1-(2), and the pH kept during heating to approximately 95° C. is replaced with approximately 5.0, in accordance with the composition shown in Table 1.

The cumulative volume average diameter $D_{50}$ of the toner particle obtained is approximately 4.40 μm, and the volume-average grain size distribution index GSDv thereof is approximately 1.19. The shape factor SF1 thereof is approximately 124 (slightly spherical).

A developer is prepared from an external additive toner prepared in a similar manner as in Example 1-1 by using the toner particles. Evaluation of fixing properties of the toner conducted in a similar manner as in Example 1-1 reveals that an oilless fixing property on a PFA tube fixing roll is favorable, a lowest fixing temperature thereof is approximately 115° C. or more, images are sufficiently fixed, and the transfer papers are relreased without any resistance. The surface glossiness of the image formed at a fixing temperature of approximately 150° C. is favorable at approximately 70%. Both of the developing property and the transfer property are favorable. The toner gives favorable high-quality images (grade B) without image defects. No hot offsetting is observed even at a fixing temperature of approximately 200° C.

In addition, evaluation of the stability of the resin particle dispersion 1-(2) before preparation of the toner by the shear-homogenizing method described above results in no generation of aggregates, indicating that the dispersion has stability (grade A).

Toner Example 1-3

Toner particles are prepared in a similar manner as in Example 1-1 except that the resin particle dispersion 1-(1) used in Example 1-1 is replaced with the resin particle dispersion 1-(3), the resin particle dispersion 1-(9) is replaced with the resin particle dispersion 1-(4), the colorant particle dispersion 1-(2) is replaced with the colorant particle dispersion 1-(3), and the amount of polyaluminum chloride is changed to 0.12 parts by weight, in accordance with the composition shown in Table 1.

The cumulative volume average diameter $D_{50}$ of the toner particle obtained is approximately 4.20 μm, the volume-average grain size distribution index GSDv thereof is approximately 1.22, and the shape factor SF1 thereof is approximately 119 (spherical).

A developer is prepared from an external additive toner prepared in a similar manner as in Example 1-1 by using the toner particles. Evaluation of fixing properties of the toner conducted in a similar manner as in Example 1-1 reveals that an oilless fixing property on a PFA tube fixing roll is favorable, a lowest fixing temperature thereof is approximately 100° C. or more, images are sufficiently fixed, and the transfer papers are released without any resistance. The surface glossiness of the image formed at a fixing temperature of approximately 150° C. is favorable at approximately 85%. Both of the developing property and the transfer property are favorable. The toner gives excellent high-quality images (grade A) without image defects. No hot offsetting is observed even at a fixing temperature of approximately 200° C.

In addition, evaluation of the stability of the resin particle dispersions 1-(2) and 1-(3) before preparation of the toner by the shear-homogenizing method described above results in no generation of aggregates, indicating that the dispersion has stability (grade A).

Toner Example 1-4

Toner particles are obtained in a similar manner as in Example 1-1, except that resin particle dispersion 1-(1) in Example 1-1 is replaced with the resin particle dispersion 1-(5), in accordance with the composition shown in Table 1.

The cumulative volume average diameter $D_{50}$ of the toner particle obtained is approximately 3.92 μm, the volume-average grain size distribution index GSDv thereof is approximately 1.22, and the shape factor SF1 thereof is approximately 135 (potato-shaped).

A developer is prepared from an external additive toner prepared in a similar manner as in Example 1-1 by using the toner particles. Evaluation of fixing properties of the toner conducted in a similar manner as in Example 1-1 reveals that an oilless fixing property on a PFA tube fixing roll is favorable, a lowest fixing temperature thereof is approximately 110° C. or more, images are sufficiently fixed, and the transfer papers are released without any resistance. The surface glossiness of the image formed at a fixing temperature of approximately 150° C. is favorable at approximately 55%. Both of the developing property and the transfer property are favorable. The toner gives favorable high-quality images (grade B) without image defects. No hot offsetting is observed even at a fixing temperature of approximately 200° C.

In addition, evaluation of the stability of the resin particle dispersion 1-(5) before preparation of the toner by the shear-homogenizing method described above results in no generation of aggregates, indicating that the dispersion has stability (grade A).

Toner Example 1-5

Toner particles are obtained in a similar manner as in Example 1-1, except that resin particle dispersion 1-(2) in Example 1-2 is replaced with the resin particle dispersion (6) so that all resin particle dispersions are the resin particle dispersion 1-(6), and thud the resin particle dispersion 1-(9) is not used, in accordance with the composition shown in Table 1.

The cumulative volume average diameter $D_{50}$ of the toner particle obtained is approximately 3.50 μm, the volume-average grain size distribution index GSDv thereof is approximately 1.25, and the shape factor SF1 thereof is approximately 120 (spherical).

A developer is prepared from an external additive toner prepared in a similar manner as in Example 1-1 by using the toner particles. Evaluation of fixing properties of the toner conducted in a similar manner as in Example 1-1 reveals that an oilless fixing property on a PFA tube fixing roll is favorable, a lowest fixing temperature thereof is approximately 90° C. or more, images are sufficiently fixed, and the transfer papers are released without any resistance. The surface glossiness of the image formed at a fixing temperature of approximately 150° C. is favorable at approximately 55%. Both of the developing property and the transfer property are favorable. The toner gives favorable high-quality images (grade B) without image defects. No hot offsetting is observed even at a fixing temperature of approximately 200° C.

In addition, evaluation of the stability of the resin particle dispersion 1-(6) before preparation of the toner by the shear-homogenizing method described above results in a generation of slight aggregates which is not substantially problematic, indicating that the dispersion nearly has stability (grade B).

Comparative Toner Example 1-1

Toner particles are obtained in a similar manner as in Example 1-2, except that resin particle dispersion 1-(2) in Example 1-2 is replaced with the resin particle dispersion 1-(7) in accordance with the composition shown in Table 1.

The cumulative volume average diameter $D_{50}$ of the toner particle obtained is approximately 5.50 μm, the volume-average grain size distribution index GSDv thereof is approximately 1.30, and the shape factor SF1 thereof is approximately 135 (potato-shaped).

A developer is prepared from an external additive toner prepared in a similar manner as in Example 1-1 by using the toner particles. Evaluation of fixing properties of the toner conducted in a similar manner as in Example 1-1 reveals that an oilless fixing property on a PFA tube fixing roll is favorable, a lowest fixing temperature thereof is approximately 120° C. or more, images are sufficiently fixed. However, releases of transfer papers are unfavorable, causing waviness and winding of the papers after image fixation. Hot offsetting is observed at a fixing temperature of approximately 180° C. There are some coarse particles in the toner. Further, image defects such as blank portions are observed (grade D).

In addition, evaluation of the stability of the resin particle dispersion 1-(7) before preparation of the toner by the shear-homogenizing method described above results in a generation of aggregates in a large amount (grade D).

Comparative Toner Example 1-2

Toner particles are obtained in a similar manner as in Example 1-2, except that resin particle dispersion 1-(2) in Example 1-2 is replaced with the resin particle dispersion 1-(8) in accordance with the composition shown in Table 1.

The cumulative volume average diameter $D_{50}$ of the toner particle obtained is approximately 5.70 μm, the volume-average grain size distribution index GSDv thereof is approximately 1.26, and the shape factor SF1 thereof is approximately 120 (spherical).

A developer is prepared from an external additive toner prepared in a similar manner as in Example 1-1 by using the toner particles. Evaluation of fixing properties of the toner conducted in a similar manner as in Example 1-1 reveals that an oilless fixing property on a PFA tube fixing roll is unfavorable. A lowest fixing temperature thereof is approximately 90° C. or more. Images are sufficiently fixed. However, releases of transfer papers are unfavorable, causing waviness and winding of the papers after image fixation. Hot offsetting is observed at a fixing temperature of approximately 140° C. Further, image defects such as blank portions are observed (grade D), thus the images do not deserve to a sufficient evaluation.

In addition, evaluation of the stability of the resin particle dispersion 1-(8) before preparation of the toner by the shear-homogenizing method described above results in a generation of some aggregates (grade C).

Comparative Toner Example 1-3

Toner particles are obtained in a similar manner as in Example 1-2, except that resin particle dispersion 1-(2) in Example 1-2 is replaced with the resin particle dispersion 1-(10) in accordance with the composition shown in Table 1.

The cumulative volume average diameter $D_{50}$ of the toner particle obtained is approximately 5.95 μm, the volume-average grain size distribution index GSDv thereof is approximately 1.40, and the shape factor SF1 thereof is approximately 118 (spherical).

A developer is prepared from an external additive toner prepared in a similar manner as in Example 1-1 by using the toner particles. Evaluation of fixing properties of the toner conducted in a similar manner as in Example 1-1 reveals that an oilless fixing property on a PFA tube fixing roll is unfavorable. A lowest fixing temperature thereof is approximately 130° C. or more. Images are sufficiently fixed. However, releases of transfer papers are unfavorable, causing waviness and winding of the papers after image fixation. Hot offsetting is observed at a fixing temperature of approximately 160° C. Further, defects in solid images and scatterings of toner are observed, thus the toner is deemed as unfavorable (grade D).

In addition, evaluation of the stability of the resin particle dispersion 1-(10) before preparation of the toner by the shear-homogenizing method described above results in a generation of a significant amount of aggregates to leave a large amount of aggregates on a nylon mesh (grade D).

Results of these Examples and Comparative Examples are summarized in Table 1. In Table 1, evaluation criteria for the stability of resin particle dispersions are as follows: Grade A: without any aggregates; Grade B: with a small number of aggregates without practical problem; Grade C: with some aggregates; and Grade D: with a large number of aggregates. In addition, the evaluation criteria for image quality are as follows: Grade A: extremely favorable; Grade B: favorable; and Grade D: with image defect.

TABLE 1

| | Toner Example | | | | | Comparative Toner Example | | |
|---|---|---|---|---|---|---|---|---|
| | 1-1 | 1-2 | 1-3 | 1-4 | 1-5 | 1-1 | 1-2 | 1-3 |
| Resin particle dispersion: parts by weight | [1] 233<br>[9] 50 | [2] 262<br>[9] 100 | [3] 246<br>[4] 300 | [5] 233<br>[9] 100 | [6] 420 | [7] 233<br>[9] 100 | [8] 280<br>[9] 100 | [10] 280<br>[9] 100 |
| Colorant dispersion: parts by weight | [1] 40 | [2] 40 | [3] 40 | [1] 40 | [1] 40 | [2] 40 | [2] 40 | [2] 40 |
| Releasing agent dispersion: parts by weight | 40 | 40 | 40 | 40 | 40 | 40 | 40 | 40 |
| Polycondensation resin: median diameter μm | [1] 0.40 | [2] 0.72 | [3] 0.22 | [5] 0.37 | [6] 1.07 | [7] 2.10 | [8] 0.025 | (10) 0.45 |
| Crystalline resin: melting point ° C. | [1] 70 | [2] 69 | [3] 55 | [5] 70 | [6] 69 | [7] 69 | [8] 48 | (10) 69 |
| Amorphous resin: glass transition point ° C. | [9] 53.5 | [9] 53.5 | [4] 55 | [9] 53.5 | — | [9] 53.5 | [9] 53.5 | [9] 53.5 |
| Resin dispersion oil: stability | A | A | A | A | B | D | C | D |
| Ratio of larger and smaller particles relative to all particles of resin dispersion (top and bottom values correspond respectively to the resin particles of the dispersion in the fist line of this table) | 1.2<br>0.2 | 4.4<br>0.2 | 0.5<br>2.3 | 1.8<br>0.2 | 8.8 | 10.8<br>0.2 | 12.0<br>0.2 | 4.5<br>0.2 |
| Toner particle diameter μm | 4.60 | 4.40 | 4.20 | 3.92 | 3.50 | 5.50 | 5.70 | 5.95 |
| Toner shape factor | 130 | 124 | 119 | 135 | 120 | 135 | 120 | 118 |
| Lowest fixing temperature ° C. | 120 | 115 | 100 | 110 | 90 | 120 | 90 | 130 |
| Hot offset temperature ° C. | 200 or more | 200 or more | 200 or more | 200 or more | 200 | 180 | 140 | 160 |
| Image quality | B | B | A | B | B | D | D | D |

The above results indicate that it is possible to efficiently produce a toner made from a polycondensation resin and drastically improve the image quality and the fixing property of the toner by adjusting the median diameter of the polycondensation resin particles that are produced by direct polymerization and emulsification and dispersion in an aqueous medium in a particular range as shown in the Examples.

In contrast, it is understood that when the median diameter of the polycondensation resin particles does not fall within the particular range though the polycondensation resin particles are produced by direct polymerization and emulsification dispersion in an aqueous medium, or when the polycondensation resin particles are separately prepared and then dispersed in an aqueous medium though the median diameter of the polycondensation resin particles falls within the particular range as in the Comparative Examples, the properties of the toner made therefrom are deteriorated comparing to those of the Examples.

Preparation of Condensation Compound Particle Dispersion 2-(1)

Dodecylbenzenesulfonic acid: 23 parts by weight

Behenic acid: 104 parts by weight

Behenyl alcohol: 100 parts by weight

Ion-exchanged water: 816 parts by weight

First, dodecylbenzenesulfonic acid, behenic acid, and behenyl alcohol in the above composition are mixed and heated to approximately 90° C. so as to obtain an oily solution. The oily solution is poured into ion-exchanged water which is previously heated at approximately 90° C., and the resulting mixture is emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 70° C. for approximately 15 hours while it is stirred.

In this manner, a condensation compound particle dispersion 2-(1) having a mean particle diameter (median diameter) of approximately 220 nm, a melting point of approximately 69° C., and a solid content of approximately 20% is obtained.

With regard to the particles in the condensation compound particle dispersion 2-(1), a ratio of larger and smaller particles relative to all particles is approximately 0.5%.

Preparation of Condensation Compound Particle Dispersion 2-(2)

Dodecylbenzenesulfonic acid: 23 parts by weight

Behenic acid: 250 parts by weight

Pentaerythritol: 25 parts by weight

Ion-exchanged water: 1,100 parts by weight

First, dodecylbenzenesulfonic acid, behenic acid, and pentaerythritol in the above composition are mixed and fused by heating the mixture to approximately 250° C. so as to obtain an oily solution. The oily solution is poured into ion-exchanged water which is previously heated at approximately 90° C., and the resulting mixture is emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 80° C. for approximately 15 hours while it is stirred.

In this manner, a condensation compound particle dispersion 2-(2) having a mean particle diameter (median diameter) of approximately 1820 nm, a melting point of approximately 85° C., and a solid content of approximately 20% is prepared.

The ratio of larger and smaller particles relative to all particles in the particles of the condensation compound particle dispersion 2-(2) is approximately 8.2%.

Preparation of Condensation Compound Particle Dispersion 2-(3)

Dodecylbenzenesulfonic acid: 30 parts by weight

Palmitic acid: 188 parts by weight

Pentaerythritol: 25 parts by weight

Ion-exchanged water: 852 parts by weight

First, dodecylbenzenesulfonic acid, palmitic acid, and pentaerythritol in the above composition are mixed and fused by heating the mixture to approximately 250° C. so as to obtain an oily solution. The oily solution is poured into ion-exchanged water which is previously heated at approximately 90° C., and the resulting mixture is emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 70° C. for approximately 15 hours while it is stirred.

In this manner, a condensation compound particle dispersion 2-(3) having a mean particle diameter (median diameter) of approximately 640 nm, a melting point of approximately 72° C., and a solid content of approximately 20% is prepared.

The ratio of larger and smaller particles relative to all particles in the particles of the condensation compound particle dispersion 2-(3) is approximately 1.5%.

Preparation of Condensation Compound Particle Dispersion 2-(4)

Isopropylbenzenesulfonic acid: 30 parts by weight

Myristic acid: 188 parts by weight

Dipentaerythritol: 25 parts by weight

Ion-exchanged water: 640 parts by weight

First, dodecylbenzenesulfonic acid, myristic acid, and dipentaerythritol in the above composition are mixed and fused by heating the mixture to approximately 210° C. so as to obtain an oily solution. The oily solution is poured into ion-exchanged water which is previously heated at approximately 95° C., and the resulting mixture is emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 80° C. for approximately 18 hours while it is stirred.

In this manner, a condensation compound particle dispersion 2-(4) having a mean particle diameter (median diameter) of approximately 420 nm, a melting point of approximately 68° C., and a solid content of approximately 20% is prepared.

The ratio of larger and smaller particles relative to all particles in the particles of the condensation compound particle dispersion 2-(4) is approximately 0.9%.

Preparation of Condensation Compound Particle Dispersion 2-(5) by Using Rare-Earth Metal Catalyst Scandium dodecylbenzenesulfonate (rare-earth metal-containing catalyst): 40 parts by weight Stearic acid: 105 parts by weight Stearyl alcohol: 100 parts by weight Ion-exchanged water: 820 parts by weight First, scandium dodecylbenzenesulfonate, stearic acid, and stearyl alcohol in the above composition are mixed and fused by heating the mixture to approximately 70° C. so as to obtain an oily solution. The oily solution is poured into ion-exchanged water which is previously heated at approximately 90° C., and the resulting mixture is emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 70° C. for approximately 15 hours while it is stirred.

In this manner, a condensation compound particle dispersion 2-(5) having a mean particle diameter (median diameter) of approximately 120 nm, a melting point of approximately 60° C., and a solid content of approximately 20% is prepared.

The ratio of larger and smaller particles relative to all particles in the particles of the condensation compound particle dispersion 2-(5) is approximately 6.8%.

Preparation of Condensation Compound Particle Dispersion 2-(6) by Using Enzyme Catalyst Dodecylbenzenesulfonic acid: 12 parts by weight Lipase (enzyme catalyst derived of Pseudomonas species): 50 parts by weight Palmitic acid: 209 parts by weight Glycerin: 25 parts by weight Ion-exchanged water: 960 parts by weight First, dodecylbenzenesulfonic acid, lipase (derived of *Pseudomonas* species), palmitic acid, and glycerin in the above composition are mixed and fused by heating the mixture to approximately 70° C. so as to obtain an oily solution. The oily solution is poured into ion-exchanged water which is previously heated at approximately 90° C., and the resulting mixture is emulsified by using a homogenizer (ULTRA-TURRAX® T50, described above) for approximately 5 minutes. Then, the emulsion is further emulsified in a supersonic wave bath for approximately 5 minutes, and the emulsified mixture is kept in a flask at approximately 70° C. for approximately 15 hours while it is stirred.

In this manner, a condensation compound particle dispersion 2-6) having a mean particle diameter (median diameter) of approximately 120 nm, a melting point of approximately 62° C., and a solid content of approximately 20% is prepared.

The ratio of larger and smaller particles relative to all particles in the particles of the condensation compound particle dispersion 2-(6) is approximately 9.0%.

Preparation of Condensation Compound Particle Dispersion 2-(7) as Comparative Example Dodecylbenzenesulfonic acid: 23 parts by weight Behenic acid: 250 parts by weight Pentaerythritol: 25 parts by weight Ion-exchanged water: 1,100 parts by weight First, behenic acid and pentaerythritol in the above composition are mixed and fused by heating the mixture to approximately 250° C. The mixture solution is poured into ion-exchanged water, in which is dodecylbenzenesulfonic acid is previously dissolved, at room temperature, and the resulting mixture is emulsified by using a homogenizer (ULTRA-TURRAX® T50, described above) for approximately 5 minutes. No further emulsification by a supersonic wave bath is conducted. The resulting mixture is kept in a flask at approximately 80° C. for approximately 15 hours while it is moderately stirred.

In this manner, a condensation compound particle dispersion 2-(7) having a mean particle diameter (median diameter) of approximately 2120 nm, a melting point of approximately 85° C., and a solid content of approximately 20% is prepared.

The ratio of larger and smaller particles relative to all particles in the particles of the condensation compound particle dispersion 2-(7) is approximately 10.5%.

Preparation of Condensation Compound Particle Dispersion 2-(8): Comparative Example First, the following condensation compounds are placed in a flask equipped with a thermometer, a nitrogen-supplying tube, a condenser tube, and a stirrer.

Behenic acid: 104 parts by weight

Behenyl alcohol: 100 parts by weight

Then, the mixture is stirred and heated to approximately 180° C. for approximately 12 hour under a nitrogen flow, while allowing the reaction water to be distillated under reduced pressure.

Approximately 180 g of the condensation compound thus obtained is weighed. The compound is added to approximately 900 g of ion-exchanged water containing approximately 2 wt % of sodium dodecylbenzenesulfonate, and the mixture is heated to approximately 80° C., dispersed by using a homogenizer (ULTRA-TURRAX® T50, described above), and additionally emulsified at approximately 90° C. by using a nanomizer (manufactured by Yoshida Kikai Co., Ltd.).

In this manner, a condensation compound particle dispersion 2-(8) having a mean particle diameter (median diameter) of approximately 820 nm, a melting point of approximately 69° C., and a solid content of approximately 20% is prepared. In addition, the ratio of larger and smaller particles relative to all particles in the particles of the condensation compound particle dispersion 2-(8) is approximately 7.2%.

Preparation of resin particle dispersion 2-(1): Crystalline polyester latex Acid components consisting of approximately 90.5 mol % of 1,10-dodecanedicarboxylic acid, approximately 2 mol % of sodium dimethyl isophthalate-5-sufonate, and approximately 7.5 mol % of 5-t-butylisophthalic acid; approximately 100 mol % of 1,9-nonanediol; and a catalyst $Ti(OBu)_4$ (approximately 0.014 wt % with respect to the acid components) are placed in a heat-dried three-necked flask. The inside of the flask is deaerated under reduced pressure and supplied with a nitrogen gas. The mixture is then mechanically stirred under reflux in an inactive atmosphere at approximately 180° C. for approximately 6 hours. Then, after removal of excessive ethylene glycol by distillation under reduced pressure, the mixture is gradually heated to approximately 220° C. and stirred at the same temperature for approximately 2 hours until the solution becomes viscous. When the weight-average molecular weight, as determined by gel-permeation chromatography (GPC), reaches approximately 11,000, the distillation under reduced pressure is terminated, and the mixture is allowed to cool in air, to give a crystalline polyester 2-(1).

Then, approximately 80 g of the crystalline polyester 2-(1) and approximately 720 g of deionized water are placed in a stainless beaker and heated to approximately 95° C. in a heating bath. The crystalline polyester resin is then agitated from the time that the crystalline polyester resin fused at a speed of approximately 8,000 rpm by using a homogenizer (ULTRA-TURRAX® T50, described above). Then, emulsification dispersion of the resulting resin with dropwise addition of approximately 20 g of a dilute aqueous solution containing approximately 1.6 g of an anionic surfactant (trade name: NEOGEN RK, manufactured by Daiichi Kogyo Seiyaku Co., Ltd.) gives a crystalline polyester resin particle dispersion 2-(1) (resin particle concentration: approximately 10 wt %) having an average diameter of approximately 0.15 μm.

Preparation of Resin Particle Dispersion 2-(2): Non-crystalline Vinyl Resin Latex Styrene: 460 parts by weight n-Butyl acrylate: 140 parts by weight Acrylic acid: 12 parts by weight Dodecanethiol: 9 parts by weight Respective components in the above composition are mixed and dissolved to give a solution. Separately, approximately 12 parts by weight of an anionic surfactant (DOWFAX™, described above) is dissolved in approximately 250 parts by weight of ion-exchanged water, than the solution above is added thereto. The thus obtained mixture is dispersed and emulsified in a flask (monomer emulsion A). Then, a solution of 1 part by weight of the same anionic surfactant (DOWFAX™, described above) in approximately 555 parts by weight of ion-exchanged water is placed in a polymerization flask. The polymerization flask is then tightly sealed, gradually heated to approximately 75° C. in a water bath, and kept at the same temperature, while the solution is gently stirred under reflux and introduced nitrogen gas therein.

Then, a solution of approximately 9 parts by weight of ammonium persulfate in approximately 43 parts by weight of ion-exchanged water is dropwisely added into the polymerization flask via a constant volume pump over a period of approximately 20 minutes. The monomer emulsion A is then dropwisely added thereto via a constant volume pump over a period of approximately 200 min.

Then, the mixture is kept at approximately 75° C. in the polymerization flask while gently stirred for approximately 3 hours, to complete polymerization.

In this manner, a non-crystalline resin particle dispersion 2-(2) having a mean particle diameter (median diameter) of approximately 210 nm, a glass transition point of approximately 53.5° C., a weight-average molecular weight of approximately 31,000, and a solid content of approximately 42% is prepared.

Preparation of Colorant Particle Dispersion 2-(1)

Yellow pigment (trade name: Y74, manufactured by Dainichiseika Color & Chemicals Mfg. Co., Ltd.): 50 parts by weight Anionic surfactant (trade name: NEOGEN R, described above): 5 parts by weight Ion-exchanged water: 200 parts by weight Respective components in the above composition are mixed and dissolved and dispersed by a homogenizer (ULTRA-TURRAX® T50, described above) for approximately 5 min and then by a supersonic wave bath for approximately for 10 minutes, to give an yellow particle dispersion 1-(1) having a mean diameter (median diameter) of approximately 240 nm and a solid content of approximately 21.5%.

Preparation of Colorant Particle Dispersion 2-(2)

A cyan colorant particle dispersion 2-(2) having a mean diameter (median diameter) of approximately 190 nm and a solid content of approximately 21.5% is prepared in a similar manner as for the colorant particle dispersion 2-(1), except that a cyan pigment (trade name: COPPER PHTHALOCYANINE B15:3, described above) is used instead of the yellow pigment used in preparation of the colorant particle dispersion 2-(1).

Preparation of Colorant Particle Dispersion 2-(3)

A colorant particle dispersion 2-(3) having a mean diameter (median diameter) of approximately 165 nm and a solid content of approximately 21.5% is prepared in a similar manner as for the colorant particle dispersion 2-(1), except that a magenta pigment (trade name: PR122, manufactured by Dainippon Ink and Chemicals, Inc.) is used instead of the yellow pigment used in preparation of the colorant particle dispersion 2-(1).

Preparation of Colorant Particle Dispersion 2-(4)

A colorant particle dispersion 2-(4) having a mean diameter (median diameter) of approximately 170 nm and a solid content of approximately 21.5% is prepared in a similar manner as for the colorant particle dispersion 2-(1), except that a black pigment (trade name: CARBON BLACK, described above) is used instead of the yellow pigment used in the preparation of the colorant particle dispersion 2-(1).

Preparation of Releasing Agent Particle Dispersion 2-(1)

Paraffin wax (trade name: HNP 9, manufactured by Nippon Seiro Co., Ltd.: melting point: 70° C.): 50 parts by weight Anionic surfactant (DOWFAX™, described above): 5 parts by weight Ion-exchanged water: 200 parts by weight A mixture of the respective components in the above composition is heated to approximately 95° C. and thoroughly dispersed by using a homogenizer (ULTRA-TURRAX® T50, described above) and additionally dispersed by using a high-pressure extrusion homogenizer (trade name: GAULIN HOMOGENIZER, described above) to give a releasing agent particle dispersion having a mean diameter (median diameter) of approximately 180 nm and a solid content of approximately 21.5%.

Toner Example 2-1

Preparation of Toner Particle

Resin particle dispersion 2-(1): 210 parts by weight (resin: 21 parts by weight)

Resin particle dispersion 2-(2): 100 parts by weight (resin: 21 parts by weight)

Colorant particle dispersion 2-(1): 28 parts by weight (pigment: 6 parts by weight)

Condensation compound particle dispersion 2-(1): 50 parts by weight (condensation compound: 10 parts by weight)

Polyaluminum chloride: 0.15 weight part

Ion-exchanged water: 300 parts by weight

A mixture of the respective components in the above composition (except for the resin particle dispersion 2-(2)) is thoroughly mixed and dispersed in a circular stainless steel flask by using a homogenizer (ULTRA-TURRAX® T50, described above) and then heated to approximately 42° C. and kept at the same temperature for approximately 60 minutes in a heated oil bath while it is stirred; then, approximately 50 parts by weight of the resin particle dispersion 2-(2) (resin: approximately 21 parts by weight) is added thereto, and the mixture is stirred gently.

A pH of the mixture is then adjusted to approximately 6.0 by adding an aqueous sodium hydroxide solution of approximately 0.5 mole/liter, and heated to approximately 95° C. while stirred. The pH of the mixture, which normally decreases to approximately 5.0 or less during heating at approximately 95° C., is adjusted so as not to decrease to approximately 5.5 or less with dropwise addition of an aqueous sodium hydroxide solution.

After reaction, the mixture is cooled and filtered. The filter cake is thoroughly washed in ion-exchanged water and filtered through a Nutsche filter under reduced pressure for solid-liquid separation. The filter cake is then redispersed in approximately 3 liter of ion-exchanged water at approximately 40° C., and the dispersion is stirred and washed at a stirring speed of approximately 300 rpm for approximately 15 minutes. The washing and filtration through the Nutsche filtration under reduced pressure is repeated five times, and then the solid is dried under vacuum for approximately 12 hours so as to give toner particles.

The cumulative volume average diameter $D_{50}$ of the toner particles, as determined in a coulter counter, is approximately 4.8 μm, and the volume-average grain size distribution index GSDv thereof is approximately 1.22. In addition, the toner particles have a potato-like shape and the shape factor SF1 of the toner particles as determined by observation using Luzex is 129.

A mixture of approximately 50 parts by weight of the toner particle and approximately 1.5 parts by weight of hydrophobic silica (trade name: TS720, manufactured by Cabot Corporation) is blended in a sample mill so as to give an external additive toner.

Then, a ferrite carrier having an average diameter of approximately 50 μm coated with polymethyl methacrylate (manufactured by Soken Chemical & Engineering Co., Ltd.) at a concentration of approximately 1% and the external additive toner in an amount of approximately 5% as toner concentration are stirred by a ball mill for approximately 5 minutes so as to give a developer.

Evaluation of Toner

Fixing properties of the toner evaluated by using the above developer and a transfer paper (trade name: J Coated Paper, described above) in a modified printing machine (trade name: DOCUCENTER COLOR500, described above) at a processing speed of approximately 180 mm/sec reveal that an oilless fixing property on a PFA tube fixing roll is favorable, a lowest fixing temperature (which is separately determined by image staining resulting from a test of cloth-wiping of image) thereof is approximately 110° C. or more, images are sufficiently fixed, and the transfer papers are released without any resistance. The developing property and the transfer property are favorable. Namely, the toner gives excellent high-quality images (grade A) without image defects. No hot offsetting is observed even at a fixing temperature of approximately 200° C.

A stability of the condensation compound particle dispersion 2-(1) before preparation of the toner is evaluated by a shear-homogenizing method, namely, a method of placing approximately 100 g of the resin particle dispersion in a 300-ml stainless beaker, homogenizing the dispersion under shear in the beaker by using a homogenizer (ULTRA-TURRAX® T50, described above) approximately for 1 minutes, filtering the resin particle dispersion through a 77-micron nylon mesh, and observing a presence or absence of aggregates, which results in generation of no aggregates, indicating that the dispersion has stability (grade A).

Toner Example 2-2

Toner particles are prepared in a similar manner as in Example 2-1, except that the condensation compound particle dispersion 2-(1) in Example 2-1 is replaced with the condensation compound particle dispersion 2-(2), the colorant particle dispersion 2-(1) is replaced with the colorant particle dispersion 2-(2), and the pH kept during heating to approximately 95° C. is replaced with approximately 5.0.

The cumulative volume average diameter $D_{50}$ of the toner particle obtained is approximately 4.60 μm, and the volume-average grain size distribution index GSDv thereof is approximately 1.19. The shape factor SF1 thereof is approximately 123 (slightly spherical).

A developer is prepared from an external additive toner prepared in a similar manner as in Example 2-1 by using the toner particles. Evaluation of fixing properties of the toner conducted in a similar manner as in Example 2-1 reveals that an oilless fixing property on a PFA tube fixing roll is favorable, a lowest fixing temperature thereof is approximately 110° C. or more, images are sufficiently fixed, and the transfer papers are relreased without any resistance. The surface glossiness of the image formed at a fixing temperature of approximately 150° C. is favorable at approximately 70%. The developing property and the transfer property are also favorable. The toner gives favorable high-quality images (grade B) without image defects. No hot offsetting is observed even at a fixing temperature of approximately 200° C.

In addition, evaluation of the stability of the condensation compound particle dispersion 2-(2) before preparation of the toner by the shear-homogenizing method described above results in little generation of aggregates, indicating that the dispersion has stability (grade B).

Toner Example 2-3

Toner particles are prepared in a similar manner as in Example 2-1, except that the condensation compound particle dispersion 2-(1) used in Example 2-1 is replaced with the condensation compound particle dispersion 2-(3), the colorant particle dispersion 2-(2) is replaced with the colorant particle dispersion 2-(3), the pH kept during heating to approximately 95° C. is replaced with approximately 5.0, and the amount of polyaluminum chloride is changed to 0.12 parts by weight.

The cumulative volume average diameter $D_{50}$ of the toner particle obtained is approximately 3.90 μm, the volume-average grain size distribution index GSDv thereof is approximately 1.22, and the shape factor SF1 thereof is approximately 120 (spherical).

A developer is prepared from an external additive toner prepared in a similar manner as in Example 2-1 by using the toner particles. Evaluation of fixing properties of the toner conducted in a similar manner as in Example 2-1 reveals that an oilless fixing property on a PFA tube fixing roll is favorable, a lowest fixing temperature thereof is approximately 100° C. or more, images are sufficiently fixed, and the transfer papers are released without any resistance. Both of the developing property and the transfer property are favorable. The toner gives favorable high-quality images (grade B) without image defects. No hot offsetting is observed even at a fixing temperature of approximately 200° C.

In addition, evaluation of the stability of the condensation compound particle dispersions 2-(2) and 2-(3) before preparation of the toner by the shear-homogenizing method described above results in little generation of aggregates, indicating that the dispersion has stability (grade B).

Toner Example 2-4

Toner particles are obtained in a similar manner as in Example 2-1, except that condensation compound particle dispersion 2-(1) in Example 2-1 is replaced with the condensation compound particle dispersion 2-(4).

The cumulative volume average diameter $D_{50}$ of the toner particle obtained is approximately 4.50 μm, the volume-average grain size distribution index GSDv thereof is approximately 1.22, and the shape factor SF1 thereof is approximately 135 (potato-shaped).

A developer is prepared from an external additive toner prepared in a similar manner as in Example 2-1 by using the toner particles. Evaluation of fixing properties of the toner conducted in a similar manner as in Example 2-1 reveals that an oilless fixing property on a PFA tube fixing roll is favorable, a lowest fixing temperature thereof is approximately 100° C. or more, images are sufficiently fixed, and the transfer papers are released without any resistance. Both the developing property and the transfer property are also favorable. The toner gives favorable high-quality images (grade B) without image defects. No hot offsetting is observed even at a fixing temperature of approximately 200° C.

In addition, evaluation of the stability of the condensation compound particle dispersion 2-(4) before preparation of the toner by the shear-homogenizing method described above results in no generation of aggregates, indicating that the dispersion has stability (grade A).

Toner Example 2-5

Toner particles are obtained in a similar manner as in Example 2-1, except that condensation compound particle dispersion 2-(1) in Example 2-1 is replaced with the condensation compound particle dispersion 2-(5) and the resin particle dispersion 2-(2) is not used so that only the resin particle dispersion 2-(1) is used as the resin particle dispersion.

The cumulative volume average diameter $D_{50}$ of the toner particle obtained is approximately 3.50 μm, the volume-average grain size distribution index GSDv thereof is approximately 1.25, and the shape factor SF1 thereof is approximately 120 (spherical).

A developer is prepared from an external additive toner prepared in a similar manner as in Example 2-1 by using the toner particles. Evaluation of fixing properties of the toner conducted in a similar manner as in Example 2-1 reveals that an oilless fixing property on a PFA tube fixing roll is favorable, a lowest fixing temperature thereof is approximately 90° C. or more, images are sufficiently fixed, and the transfer papers are released without any resistance. Both the developing property and the transfer property are favorable. The toner gives favorable high-quality images (grade B) without image defects. Hot offsetting is a little observed at a fixing temperature of approximately 200° C.

In addition, evaluation of the stability of the condensation compound particle dispersion 2-(5) before preparation of the toner by the shear-homogenizing method described above results in no generation of aggregates, indicating that the dispersion has stability (grade A).

Toner Example 2-6

Toner particles are obtained in a similar manner as in Example 2-1, except that the condensation compound particle dispersion 2-(1) in Example 2-1 is replaced with the condensation compound particle dispersion 2-(6), the resin particle dispersion 2-(1) is not used so that only the resin particle dispersion 2-(2) is used as the resin particle dispersion, the colorant particle dispersion 2-(1) in Example 2-1 is replaced with the colorant particle dispersion 2-(2), and 20 parts by weight of the releasing agent dispersion is further added.

The cumulative volume average diameter $D_{50}$ of the toner particle obtained is approximately 4.90 μm, the volume-average grain size distribution index GSDv thereof is approximately 1.20, and the shape factor SF1 thereof is approximately 132 (potato-shaped).

A developer is prepared from an external additive toner prepared in a similar manner as in Example 2-1 by using the toner particles. Evaluation of fixing properties of the toner conducted in a similar manner as in Example 2-1 reveals that an oilless fixing property on a PFA tube fixing roll is favorable, a lowest fixing temperature thereof is approximately 130° C. or more, images are sufficiently fixed, and the transfer papers are released without any resistance. Both the developing property and the transfer property are favorable. The toner gives favorable high-quality images (grade B) without image defects. No hot offsetting is observed even at a fixing temperature of approximately 200° C.

In addition, evaluation of the stability of the condensation compound particle dispersion 2-(6) before preparation of the toner by the shear-homogenizing method described above results in a generation of slight aggregates, indicating that the dispersion nearly has stability (grade B).

Comparative Toner Example 2-1

Toner particles are obtained in a similar manner as in Example 2-1, except that condensation compound particle dispersion 2-(2) in Example 2-1 is replaced with the condensation compound particle dispersion 2-(7).

The cumulative volume average diameter $D_{50}$ of the toner particle obtained is approximately 5.50 μm, the volume-average grain size distribution index GSDv thereof is approximately 1.30, and the shape factor SF1 thereof is approximately 135 (potato-shaped).

A developer is prepared from an external additive toner prepared in a similar manner as in Example 2-1 by using the toner particles. Evaluation of fixing properties of the toner conducted in a similar manner as in Example 2-1 reveals that an oilless fixing property on a PFA tube fixing roll is favor able, a lowest fixing temperature thereof is approximately 120° C. or more, images are sufficiently fixed. However, releases of transfer papers are unfavorable, causing waviness and winding of the papers after image fixation. Hot offsetting is observed at a fixing temperature of approximately 180° C. There are some coarse particles in the toner. Further, image defects such as blank portions are observed (grade D).

In addition, evaluation of the stability of the condensation compound particle dispersion 2-(7) before preparation of the toner by the shear-homogenizing method described above results in a generation of aggregates in a large amount (grade D).

Comparative Toner Example 2-2

Toner particles are obtained in a similar manner as in Example 2-1, except that condensation compound particle dispersion 2-(1) in Example 2-1 is replaced with the condensation compound particle dispersion 2-(8).

The cumulative volume average diameter $D_{50}$ of the toner particle obtained is approximately 5.8 μm, the volume-average grain size distribution index GSDv thereof is approximately 1.35, and the shape factor SF1 thereof is approximately 120 (spherical).

A developer is prepared from an external additive toner prepared in a similar manner as in Example 2-1 by using the toner particles. Evaluation of fixing properties of the toner conducted in a similar manner as in Example 2-1 reveals that an oilless fixing property on a PFA tube fixing roll is unfavorable. Further, in the aspect of evaluation of a lowest fixing temperature, releases of transfer papers are unfavorable, and hot offsetting is significantly observed, thus the images do not deserve to a sufficient evaluation. Furthermore, there are some coarse particles in the toner, and image defects such as blank portions are observed (grade D).

In addition, evaluation of the stability of the condensation compound particle dispersion 2-(8) before preparation of the toner by the shear-homogenizing method described above results in a generation of a significant amount of aggregates (grade D).

Results of these Examples and Comparative Examples are summarized in Table 2. In Table 2, evaluation criteria for the stability of condensation compound particle dispersions are as follows: Grade A: without any aggregates; Grade B: with a small number of aggregates without practical problem; Grade C: with some aggregates; and Grade D: with a large number of aggregates. In addition, the evaluation criteria for image quality are as follows: Grade A: extremely favorable; Grade B: favorable; and Grade D: with image defect.

TABLE 2

| | Toner Example | | | | | | Comparative Toner Example | |
|---|---|---|---|---|---|---|---|---|
| | 2-1 | 2-2 | 2-3 | 2-4 | 2-5 | 2-6 | 2-1 | 2-2 |
| Resin particle dispersion: parts by weight | [1] 210<br>[2] 100 | [1] 210<br>[2] 100 | [1] 210<br>[2] 100 | [1] 210<br>[2] 100 | [1] 420<br>[2] 0 | [1] 0<br>[2] 200 | [1] 210<br>[2] 100 | [1] 210<br>[2] 100 |
| Colorant dispersion: parts by weight | [1] 40 | [2] 40 | [3] 40 | [1] 40 | [1] 40 | [2] 40 | [2] 40 | [2] 40 |
| Releasing agent dispersion: parts by weight | 0 | 0 | 0 | 0 | 0 | [1] 20 | 0 | 0 |
| Condensation compound dispersion: parts by weight | [1] 50 | [2] 50 | [3] 50 | [4] 50 | [5] 50 | [6] 50 | [7] 50 | [8] 50 |
| Condensation compound: median diameter μm | 0.22 | 1.82 | 0.64 | 0.42 | 0.12 | 0.12 | 2.12 | 0.82 |
| Condensation compound: melting point ° C. | 69 | 85 | 72 | 68 | 60 | 62 | 85 | 69 |
| Condensation compound dispersion: stability | A | B | B | A | A | B | D | D |
| Condensation compound dispersion Ratio of larger and smaller particles relative to all particles | 0.5 | 8.2 | 1.5 | 0.9 | 6.8 | 9.0 | 10.5 | 7.2 |
| Toner particle diameter μm | 4.8 | 4.6 | 3.9 | 4.5 | 3.5 | 4.9 | 5.5 | 5.8 |
| Toner shape factor | 129 | 123 | 120 | 135 | 120 | 132 | 135 | 120 |
| Lowest fixing temperature ° C. | 110 | 110 | 100 | 100 | 90 | 130 | 120 | — |
| Hot offset temperature ° C. | 200 or more | 200 or more | 200 or more | 200 or more | 200 | 200 or more | 180 | — |
| Image quality | A | B | B | B | B | B | D | D |

The above results indicate that it is possible to efficiently produce a toner made from a condensation compound and drastically improve the image quality and the fixing property of the toner by adjusting the median diameter of the condensation compound particles that are produced by direct polymerization and emulsification and dispersion in an aqueous medium in a particular range as shown in the Examples.

In contrast, it is understood that when the median diameter of the condensation compound particles does not fall within the particular range though the condensation compound particles are produced by direct polymerization and emulsification dispersion in an aqueous medium, or when the condensation compound particles are separately prepared and then dispersed in an aqueous medium though the median diameter of the condensation compound particles falls within the particular range as in the Comparative Examples, the properties (such as image quality or fixation property) of the toner made therefrom are deteriorated comparing to those of the Examples.

What is claimed is:

1. A resin particle dispersion for an electrostatic image-developing toner comprising polycondensation resin particles, wherein the polycondensation resin particles are prepared by polycondensation of polycondensable monomers in an aqueous medium and have a median diameter of approximately 0.05 to 2.0 μm;

wherein a weight ratio of the polycondensation resin particles that have a median diameter of approximately 0.03 μm or less in the dispersion is approximately 5% or less relative to a total weight of the polycondensation resin particles, and a weight ratio of the polycondensation resin particles that have a median diameter of approximately 5.0 μm or more in the dispersion is approximately 5% or less relative to a total weight of the polycondensation resin particles.

2. The resin particle dispersion according to claim 1, wherein the polycondensation resin particles are crystalline and have a crystal melting point of from approximately 50° C. to approximately 120 C.

3. The resin particle dispersion according to claim 1, wherein the polycondensation resin particles are non-crystalline and have a glass transition point of from approximately 50° C. to approximately 80° C.

4. The resin particle dispersion according to claim 1, wherein the polycondensable monomer contains at least a polyvalent carboxylic acid and a polyol.

5. The resin particle dispersion according to claim 1, wherein the polycondensable monomer is polycondensed in a presence of an acid having surfactant properties as a polycondensation catalyst.

6. The resin particle dispersion according to claim 1, wherein the polycondensable monomer is polycondensed in a presence of a rare-earth metal-containing catalyst as a polycondensation catalyst.

7. The resin particle dispersion according to claim 1, wherein the polycondensable monomer is polycondensed in a presence of a hydrolytic enzyme as a polycondensation catalyst.

8. The resin particle dispersion according to claim 1, wherein the median diameter is approximately 0.1 to 1.5 μm.

9. The resin particle dispersion according to claim 1, wherein the median diameter is approximately 0.1 to 1.0 μm.

10. The resin particle dispersion according to claim 1, wherein a weight ratio of the polycondensation resin particles that have the median diameter of approximately 0.03 μm or less is approximately 10% or less relative to a total weight of the polycondensation resin particles, and a weight ratio of the polycondensation resin particles that have the median diameter of approximately 5.0 μm or more in the dispersion is approximately 10% or less relative to the total weight of the polycondensation resin particles.

11. A condensation compound particle dispersion for an electrostatic image-developing toner comprising condensation compound particles, wherein the condensation compound particles are prepared by dehydration condensation of a condensable compound in an aqueous medium and have a median diameter of approximately 0.05 to 2.0 μm wherein a weight ratio of the condensation compound particles that have the median diameter of approximately 0.03 μm or less in the dispersion is approximately 5% or less relative to a total weight of the condensation compound particles, and a weight ratio of the condensation compound particles that have the median diameter of approximately 5.0 μm or more in the dispersion is approximately 5% or less relative to a total weight of the condensation compound particles.

12. The condensation compound particle dispersion according to claim 11, wherein the condensation compound particles are crystalline and have a crystal melting point of from approximately 50° C. to 120° C.

13. The condensable compound particle dispersion according to claim 11, wherein the condensable compound contains at least a polyvalent carboxylic acid and a polyol.

14. The condensation compound particle dispersion according to claim 11, wherein the condensable compound is dehydration-condensed in a presence of an acid having surfactant properties as a dehydration condensation catalyst.

15. The condensation compound particle dispersion according to claim 11, wherein the condensable compound is dehydration-condensed in a presence of a rare-earth metal-containing catalyst as a dehydration condensation catalyst.

16. The condensation compound particle dispersion according to claim 11, wherein the condensable compound is dehydration-condensed in a presence of a hydrolytic enzyme as a dehydration condensation catalyst.

17. The condensation compound particle dispersion according to claim 11, wherein the median diameter is approximately 0.1 to 1.5 μm.

18. The condensation compound particle dispersion according to claim 11, wherein the median diameter is approximately 0.1 to 1.0 μm.

* * * * *